US008809819B2

(12) United States Patent
Yabu et al.

(10) Patent No.: US 8,809,819 B2
(45) Date of Patent: Aug. 19, 2014

(54) TARGET SUPPLY UNIT AND EXTREME ULTRAVIOLET LIGHT GENERATION APPARATUS

(75) Inventors: Takayuki Yabu, Hiratsuka (JP); Hiroshi Umeda, Hiratsuka (JP); Hakaru Mizoguchi, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 13/419,148

(22) Filed: Mar. 13, 2012

(65) Prior Publication Data

US 2012/0241650 A1 Sep. 27, 2012

(30) Foreign Application Priority Data

Mar. 23, 2011 (JP) ..... 2011-064966
Dec. 28, 2011 (JP) ..... 2011-288039

(51) Int. Cl.
*G21K 5/00* (2006.01)
*G03G 15/02* (2006.01)

(52) U.S. Cl.
USPC ..... 250/504 R; 250/496.1; 250/492.1; 361/225

(58) Field of Classification Search
USPC ..... 250/504 R, 496.1, 492.1; 361/225
See application file for complete search history.

(56) References Cited

U.S. PATENT DOCUMENTS 5,991,360 A 11/1999 Matsui et al.
6,377,651 B1 4/2002 Richardson et al.
6,479,830 B1 * 11/2002 Fornaca et al. ..... 250/492.21
6,507,641 B1 * 1/2003 Kondo et al. ..... 378/119
6,867,843 B2 3/2005 Ogushi et al.
6,906,788 B2 * 6/2005 Bakker et al. ..... 355/69
7,067,832 B2 6/2006 Mizoguchi et al.
7,446,329 B2 * 11/2008 Bristol et al. ..... 250/504 R
7,642,533 B2 * 1/2010 Partio et al. ..... 250/504 R
2009/0272919 A1 * 11/2009 Abe et al. ..... 250/504 R
2010/0019173 A1 * 1/2010 Someya et al. ..... 250/496.1
2010/0200776 A1 * 8/2010 Yabu et al. ..... 250/504 R
2011/0204249 A1 8/2011 Nagai et al.
2011/0284774 A1 * 11/2011 Ishihara et al. ..... 250/504 R
2011/0310365 A1 * 12/2011 Yabu et al. ..... 355/30
2012/0217422 A1 * 8/2012 Yabu et al. ..... 250/504 R
2013/0048878 A1 * 2/2013 Mizoguchi et al. ..... 250/492.1

FOREIGN PATENT DOCUMENTS

WO WO 2010137625 A1 * 12/2010 ..... H05G 2/00

* cited by examiner

*Primary Examiner* — Michael Logie

(74) *Attorney, Agent, or Firm* — McDermott Will & Emery LLP

(57) ABSTRACT

A target supply unit may include: a target storage unit for storing a target material thereinside; a target output unit having a through-hole formed therein, through which the target material stored inside the target storage unit is outputted; an electrode having a through-hole formed therein arranged to face the target output unit, the electrode being coated with an electrically conductive material at least on a part of a surface facing the target output unit; and a voltage generator for applying a voltage between the target material and the electrode.

16 Claims, 15 Drawing Sheets

| MATERIAL | WORK FUNCTION (eV) |
|---|---|
| Se | 5.9 |
| Pt | 5.65 |
| Ir | 5.27 |
| Ni | 5.15 |
| Au | 5.1 |
| C | 5 |
| Co | 5 |
| Be | 4.98 |
| Rh | 4.98 |
| Re | 4.96 |
| Te | 4.95 |
| Si | 4.85 |
| Os | 4.83 |
| Ru | 4.71 |

TARGET SUPPLY UNIT AND EXTREME ULTRAVIOLET LIGHT GENERATION APPARATUS

CROSS-REFERENCE TO RELATED APPLICATIONS

The present application claims priority from Japanese Patent Application No. 2011-064966 filed Mar. 23, 2011, and Japanese Patent Application No. 2011-288039 filed Dec. 28, 2011.

BACKGROUND

1. Technical Field

This disclosure relates to a target supply unit and an extreme ultraviolet (EUV) light generation apparatus.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used.

SUMMARY

A target supply unit according to one aspect of this disclosure may include: a target storage unit for storing a target material thereinside; a target output unit having a through-hole formed therein, through which the target material stored inside the target storage unit is outputted; an electrode having a through-hole formed therein arranged to face the target output unit, the electrode being coated with an electrically conductive material at least on a part of a surface facing the target output unit; and a voltage generator for applying a voltage between the target material and the electrode.

A target supply unit according to another aspect of this disclosure may include: a target storage unit for storing a target material thereinside; a target output unit having a through-hole formed therein, through which the target material stored inside the target storage unit is outputted; an electrode having a through-hole formed therein arranged to face the target output unit, the electrode being formed of at least one of selenium (Se), platinum (Pt), iridium (Ir), nickel (Ni), gold (Au), carbon (C), and cobalt (Co); and a voltage generator for applying a voltage between the target material and the electrode.

An extreme ultraviolet light generation apparatus according to yet another aspect of this disclosure may be used with a laser apparatus and may include: a target storage unit for storing a target material thereinside; a target output unit having a through-hole formed therein, through which the target material stored inside the target storage unit is outputted; an electrode having a through-hole formed therein arranged to face the target output unit, the electrode being coated with an electrically conductive material at least on a part of a surface facing the target output unit; a voltage generator for applying a voltage between the target material and the electrode; and a chamber having an inlet through which a laser beam from the laser apparatus is introduced into the chamber.

An extreme ultraviolet light generation apparatus according to still another aspect of this disclosure may be used with a laser apparatus and may include: a target storage unit for storing a target material thereinside; a target output unit having a through-hole formed therein, through which the target material stored inside the target storage unit is outputted; an electrode having a through-hole formed therein arranged to face the target output unit, the electrode being formed of at least one of selenium (Se), platinum (Pt), iridium (Ir), nickel (Ni), gold (Au), carbon (C), and cobalt (Co); a voltage generator for applying a voltage between the target material and the electrode; and a chamber having an inlet through which a laser beam from the laser apparatus is introduced into the chamber.

BRIEF DESCRIPTION OF THE DRAWINGS

Hereinafter, selected embodiments of this disclosure will be described with reference to the accompanying drawings.

DESCRIPTION OF PREFERRED EMBODIMENTS

Figure 1:
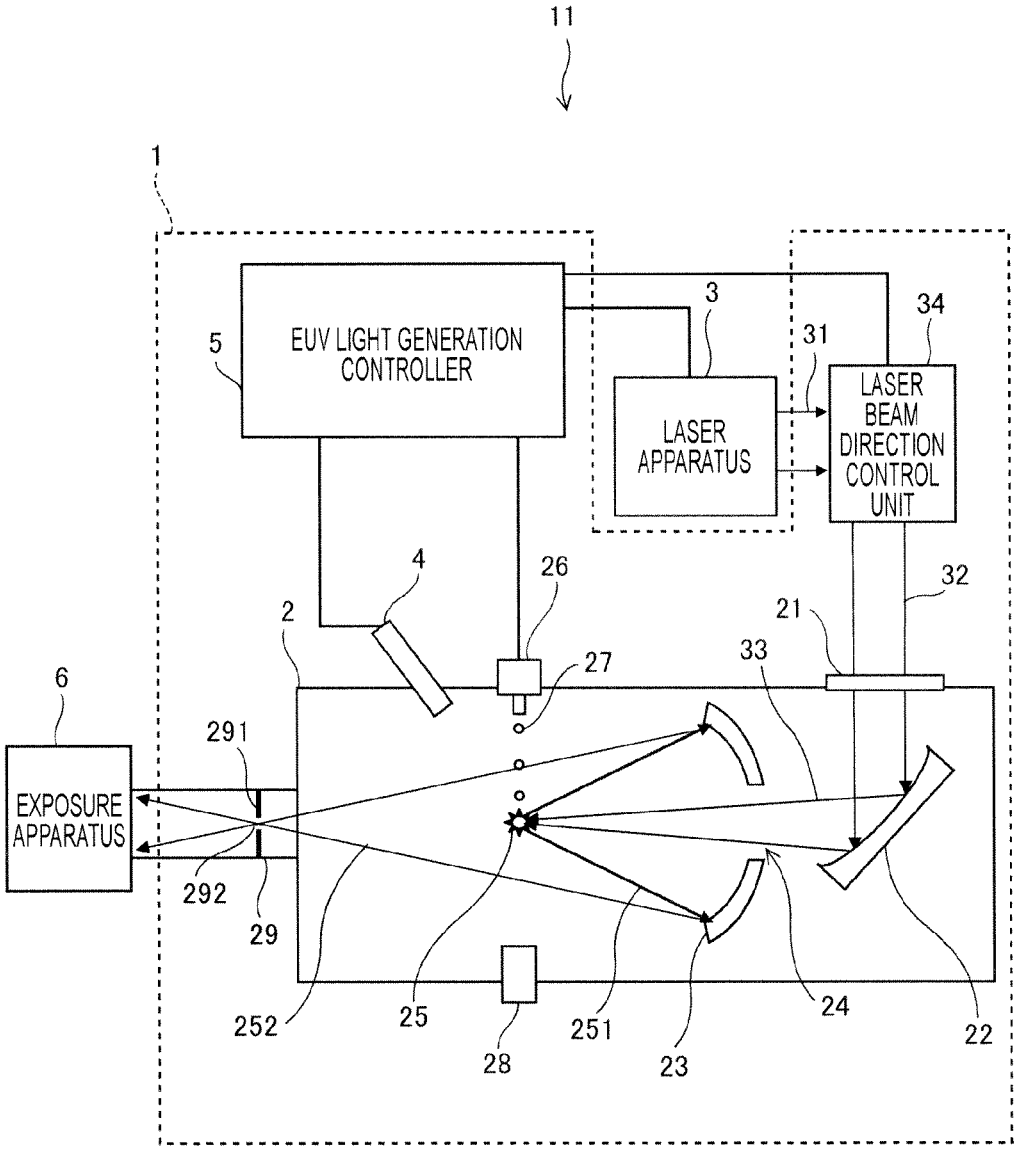
FIG. 1 schematically illustrates the configuration of an exemplary LPP type EUV light generation system.

Hereinafter, selected embodiments of this disclosure will be described in detail with reference to the accompanying drawings. The embodiments to be described below are merely illustrative in nature and do not limit the scope of this disclosure. Further, configurations and operations described in each embodiment are not all essential in implementing this disclosure. Like elements are referenced by like reference numerals and symbols, and duplicate descriptions thereof will be omitted herein. The embodiments of this disclosure will be described following the table of contents below.

Contents

1. Overview
2. Overview of EUV Light Generation System
2.1 Configuration
2.2 Operation
3. Chamber Including Electrostatic-Pull-Out Type Target Generator
3.1 Configuration
3.2 Operation
4. Electrostatic-Pull-Out Type Target Generator
4.1 Configuration
4.2 Operation
4.3 Effect
5. Breakdown Voltage Enhancement of Target Generator with Electrically Conductive Nozzle
6. Breakdown Voltage Enhancement of Target Generator with Electrically Non-Conductive Nozzle
7. Target Generator with Acceleration Electrode
7.1 Configuration
7.2 Operation
8. Structure of Insulator
9. Target Generator with Acceleration Electrode and Deflection Electrodes
9.1 Configuration
9.2 Operation
9.3 Effect
10. Continuous-Jet Type Target Generator
10.1 Configuration
10.2 Operation
10.3 Effect
11. Controlling Travel Direction of Target using Deflection Electrodes

1. Overview

In an LPP type EUV light generation apparatus, a target supply unit may be configured to supply a target toward a plasma generation region inside a chamber. When the target reaches the plasma generation region, the target may be irradiated by a pulsed laser beam. Upon being irradiated by the pulsed laser beam, the target may be turned into plasma and EUV light may be emitted from the plasma.

In order to supply the targets stably toward the plasma generation region, it may be necessary to charge the targets by applying a high voltage between the target material and an electrode provided in the target supply unit and to control the trajectory and/or speed of the charged targets through an electric field or a magnetic field.

However, when a gas is present inside the chamber and a voltage applied between the target material and the electrode which exceeds a breakdown voltage, a breakdown (spark discharge) may occur, and leakage current may flow therebetween, whereby the voltage between the target material and the electrode may not be stabilized. Consequently, charges given to the targets may fluctuate, and the charged targets may not be supplied stably toward the plasma generation region.

According to one or more embodiments of this disclosure, a target supply unit may be configured such that a distance between a nozzle, through which the target material is outputted, and the electrode is set to fall within a predetermined range so that a potential gradient necessary to pull out the targets is formed, while the effect of the relationship between the gas pressure and the distance between the target material and the electrode on the breakdown voltage is taken into consideration. Further, according to one or more embodiments of this disclosure, a noble metal, such as selenium (Se) and platinum (Pt), may be used as a material for at least the surfaces of one or more electrodes provided around the trajectory of the targets. Furthermore, according to one or more embodiments of this disclosure, at least part an of the surfaces of the electrodes may be coated with electrically non-conductive material. Through these, electrons emitted from the electrode may be reduced, leading to the breakdown voltage enhancement and in turn to suppression of a dielectric breakdown.

2. Overview of EUV Light Generation System

2.1 Configuration

FIG. 1 schematically illustrates the configuration of an exemplary LPP type EUV light generation system. An EUV light generation apparatus 1 may be used with at least one laser apparatus 3. In this application, a system including the EUV light generation apparatus 1 and the laser apparatus 3 may be referred to as an EUV light generation system 11. As illustrated in FIG. 1 and described in detail below, the EUV light generation apparatus 1 may include a chamber 2 and a target supply unit (target generator 26, for example). The chamber 2 may be airtightly sealed. The target supply unit 26 may be mounted to the chamber 2 so as to pass through a wall of the chamber 2, for example. A target material to be supplied by the target supply unit 26 may include, but is not limited to, tin, terbium, gadolinium, lithium, xenon, or any combination thereof.

The chamber 2 may have at least one through-hole formed in the wall thereof. The through-hole may be covered with a window 21, and a pulsed laser beam 32 may travel through the window 21 into the chamber 2. An EUV collector mirror 23 having a spheroidal surface may be provided inside the chamber 2, for example. The EUV collector mirror 23 may have a multi-layered reflective film formed on the spheroidal surface thereof, and the reflective film may include molybdenum and silicon that is laminated in alternate layers, for example. The EUV collector mirror 23 may have a first focus and a second focus. The EUV collector mirror 23 may preferably be positioned such that the first focus thereof lies in a plasma generation region 25 and the second focus thereof lies in an intermediate focus (IF) region 292 defined by the specification of an exposure apparatus. The EUV collector mirror 23 may have a through-hole 24 formed at the center thereof, and a pulsed laser beam 33 may travel through the through-hole 24.

Referring again to FIG. 1, the EUV light generation system 11 may include an EUV light generation controller 5. Further, the EUV light generation apparatus 1 may include a target sensor 4. The target sensor 4 may be equipped with an imaging function and may detect at least one of the presence, trajectory, and position of a target.

The EUV light generation apparatus 1 may include a connection part 29 for allowing the interior of the chamber 2 and the interior of the exposure apparatus 6 to be in communication with each other. A wall 291 having an aperture may be provided inside the connection part 29. The wall 291 may be positioned such that the second focus of the EUV collector mirror 23 lies in the aperture formed in the wall 291.

Further, the EUV light generation system 11 may include a laser beam direction control unit 34, a laser beam focusing mirror 22, and a target collection unit 28 for collecting the targets 27. The laser beam direction control unit 34 may include an optical element for defining the direction in which the laser beam travels and an actuator for adjusting the position and the orientation (or posture) of the optical element.

2.2 Operation

With reference to FIG. 1, a pulsed laser beam 31 outputted from the laser apparatus 3 may pass through the laser beam direction control unit 34, and may be outputted from the laser beam direction control unit 34 as a pulsed laser beam 32 after having its direction optionally adjusted. The pulsed laser beam 32 may travel through the window 21 and enter the chamber 2. The pulsed laser beam 32 may travel inside the chamber 2 along at least one beam path from the laser apparatus 3, be reflected by the laser beam focusing mirror 22, and strike at least one target 27, as a pulsed laser beam 33.

The target generator 26 may output the targets 27 toward the plasma generation region 25 inside the chamber 2. The target 27 may be irradiated by at least one pulse of the pulsed laser beam 33. The target 27, which has been irradiated by the pulsed laser beam 33, may be turned into plasma, and rays of light including EUV light 251 may be emitted from the plasma. The EUV light 251 may be reflected selectively by the EUV collector mirror 23. EUV light 252 reflected by the EUV collector mirror 23 may travel through the intermediate focus region 292 and be outputted to the exposure apparatus 6. The target 27 may be irradiated by multiple pulses included in the pulsed laser beam 33.

The EUV light generation controller 5 may integrally control the EUV light generation system 11. The EUV light generation controller 5 may process image data of the droplet 27 captured by the target sensor 4. Further, the EUV light generation controller 5 may control at least one of the timing at which the target 27 is outputted and the direction into which the target 27 is outputted (e.g., the timing at which and/or direction in which the target is outputted from target generator 26), for example. Furthermore, the EUV light generation controller 5 may control at least one of the timing at which the laser apparatus 3 oscillates (e.g., by controlling laser apparatus 3), the direction in which the pulsed laser beam 31 travels (e.g., by controlling laser beam direction control unit 34), and the position at which the pulsed laser beam 33 is focused (e.g., by controlling laser apparatus 3, laser beam direction control unit 34, or the like), for example. The various controls mentioned above are merely examples, and other controls may be added or substituted as desired.

Figure 2:
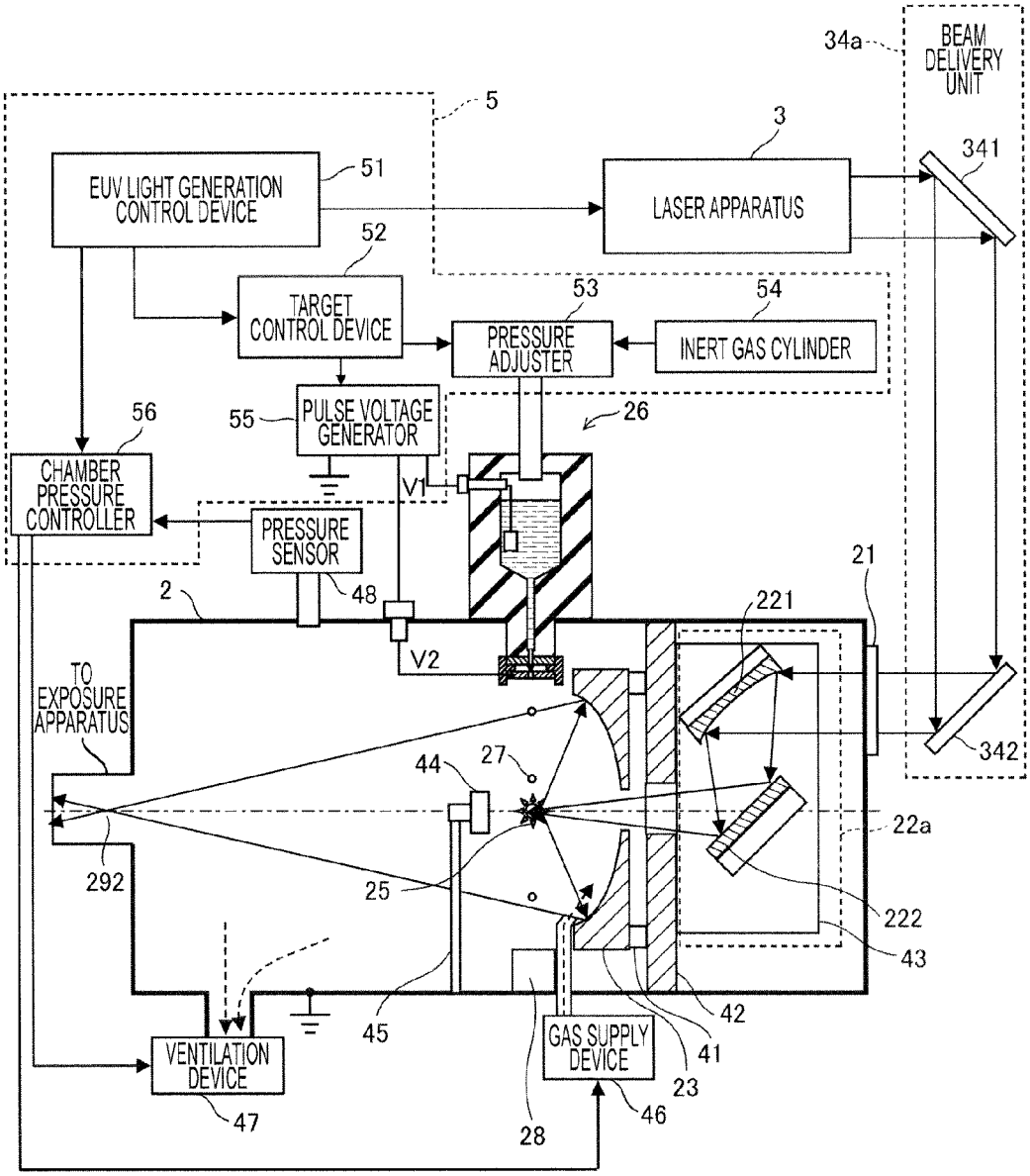
FIG. 2 illustrates the configuration of an EUV light generation system according to a first embodiment, in which a part of the system is shown in other sectional views.

3. Chamber Including Electrostatic-Pull-Out Type Target Generator 3.1 Configuration FIG. 2 illustrates the configuration of an EUV light generation system according to a first embodiment, in which a part of the system is shown in sectional views. As illustrated in FIG. 2, a laser beam focusing optical system 22*a*, the EUV collector mirror 23, the target collection unit 28, an EUV collector mirror mount 41, plates 42 and 43, a beam dump 44, a beam dump support member 45 may be provided inside the chamber 2.

The chamber 2 may include a structural member formed of a material, such as a metal, that excels in electrical conductivity (hereinafter, referred to as an electrically conductive structural member). The chamber 2 may further include a structural member having electrically non-conductive properties. In that case, the wall of the chamber 2 may, for example, be formed of the electrically conductive structural member and the structural element(s) having electrically non-conductive properties may be disposed inside the chamber 2. The plate 42 may be attached to the chamber 2, and the plate 43 may be attached to the plate 42. The EUV collector mirror 23 may be attached to the plate 42 via the EUV collector mirror mount 41.

The laser beam focusing optical system 22*a* may include an off-axis paraboloidal mirror 221 and a flat mirror 222, and these mirrors may be held by respective mounts. The off-axis paraboloidal mirror 221 and the flat mirror 222 may be attached adjustably to the plate 43 via the respective mounts such that a laser beam reflected sequentially by these mirrors is focused in the plasma generation region 25. The beam dump 44 may be attached to the chamber 2 via the beam dump support member 45 so as to be positioned in a beam path of the laser beam downstream from the plasma generation region 25. The target collection unit 28 may be disposed in the chamber 2 in an extension of the trajectory of the targets 27 downstream from the plasma generation region 25.

The chamber 2 may include the window 21 and the target generator 26 of an electrostatic-pull-out type. Details of the target generator 26 will be given later. An electrically conductive metal or any other suitable material may be used as the target material. In one or more of the embodiments disclosed in this application, tin (Sn) may be used as the target material, for example. Further, a gas supply device 46, a ventilation device 47, and a pressure sensor 48 may be connected to the chamber 2.

A beam delivery unit 34*a* and the EUV light generation controller 5 may be provided outside the chamber 2. The beam delivery unit 34*a* may include high-reflection mirrors 341 and 342, and these mirrors may be held by respective mounts (not shown). The high-reflection mirrors 341 and 342 and the mounts for the respective mirrors may be housed in a housing (not shown). The EUV light generation controller 5 may include an EUV light generation control device 51, a target control device 52, a pressure adjuster 53, an inert gas cylinder 54, a pulse voltage generator 55, and a chamber pressure controller 56. Here, the pulse voltage generator 55 may be a constituent element of the target generator 26. The chamber pressure controller 56 may be connected to the gas supply device 46, the ventilation device 47, and the pressure sensor 48 via respective signal lines.

3.2 Operation

A buffer gas and/or an etching gas may be introduced into the chamber 2. The buffer gas may serve to reduce the amount of debris, which is generated when the target material is irradiated by the laser beam, deposited on the EUV collector mirror 23. The etching gas may serve to etch the debris deposited on the EUV collector mirror 23. Argon (Ar), neon (Ne), helium (He), or any other suitable gas may be used as the buffer gas, and hydrogen ($H_2$), hydrogen bromide (HBr), hydrogen chloride (HCl), or any other suitable gas may be used as the etching gas. The etching gas may function as the buffer gas in some cases.

The gas supply device 46 may supply hydrogen gas so as to flow along the reflective surface of the EUV collector mirror 23. In that case, tin (Sn) deposited on the surface of the EUV collector mirror 23 may be etched through a reaction expressed as follows:

$$Sn(solid)+2H_2(gas)\rightarrow SnH_4(gas)$$

The ventilation device 47 may exhaust hydrogen ($H_2$) and stannane ($SnH_4$) inside the chamber 2. The chamber pressure controller 56 may be configured to control the gas supply device 46 and the ventilation device 47 based on a detection signal from the pressure sensor 48. With this, the gas pressure of the buffer gas and/or the etching gas may be retained at predetermined pressure.

The target generator 26 may be configured to generate charged droplets (targets) of the target material and supply the generated targets toward the plasma generation region 25. The laser beam outputted from the laser apparatus 3 may be reflected by the high-reflection mirrors 341 and 342 of the beam delivery unit 34*a*, travel through the window 21, and enter the laser beam focusing optical system 22*a*. The laser beam that has entered the laser beam focusing optical system 22*a* may be reflected by the off-axis paraboloidal mirror 221 and the flat mirror 222 and focused in the plasma generation region 25.

The EUV light generation control device 51 may be configured to output a target output signal to the target control device 52 and output a laser beam output signal to the laser apparatus 3. With this, the target 27 may be outputted from the target generator 26 and irradiated by the laser beam when the target 27 reaches the plasma generation region 25. Upon being irradiated by the laser beam, the target may be turned into plasma and the EUV light may be emitted from the plasma. The emitted EUV light may be reflected by the EUV collector mirror 23 so as to be focused in the intermediate focus region 292 and may be outputted to the exposure apparatus.

4. Electrostatic-Pull-Out Type Target Generator 4.1 Configuration

Figure 3A:
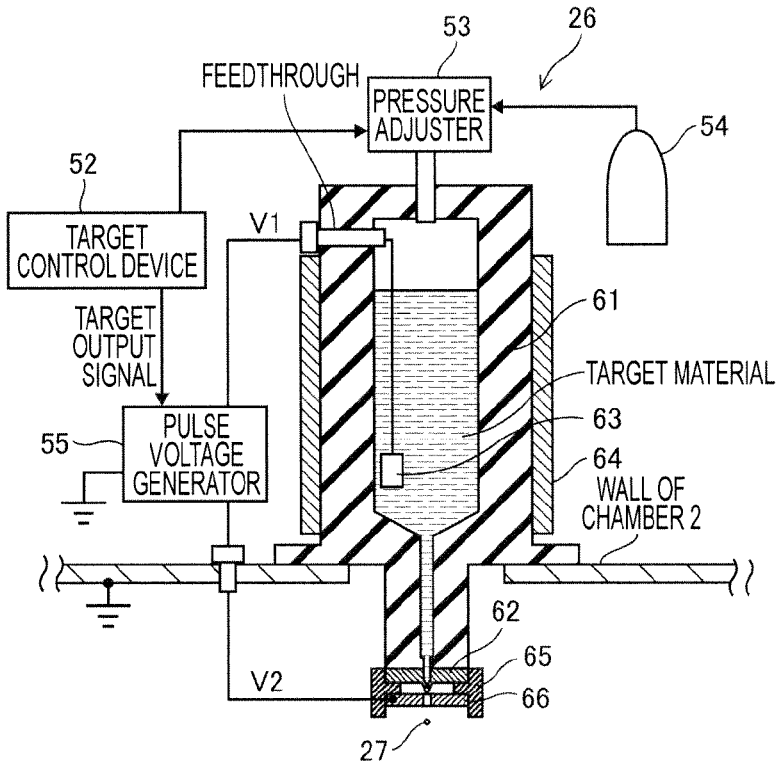
FIG. 3A is a sectional view illustrating a target generator shown in FIG. 2 and peripheral components thereof.
Figure 3B:
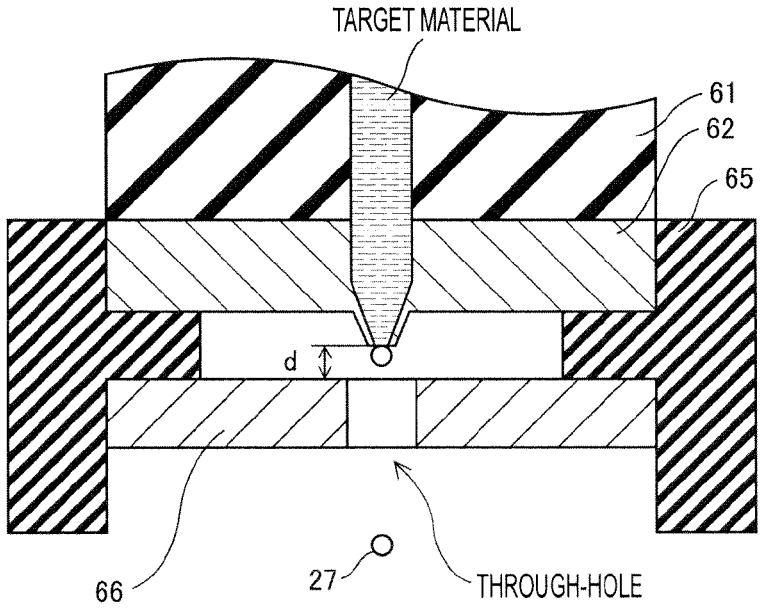
FIG. 3B is an enlarged sectional view illustrating a part of the target generator shown in FIG. 3A.
Figure 3C:
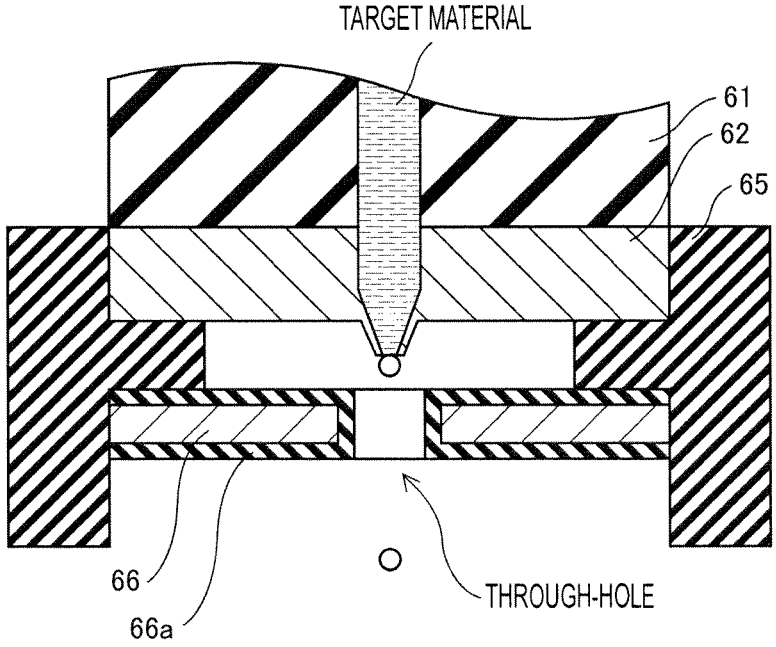
FIG. 3C is an enlarged sectional view illustrating a part of a modification of the target generator shown in FIG. 3A.

FIG. 3A is a sectional view illustrating the target generator shown in FIG. 2 and peripheral components thereof. FIG. 3B is an enlarged sectional view illustrating a part of the target generator shown in FIG. 3A. FIG. 3C is an enlarged sectional view illustrating a part of a modification of the target generator shown in FIG. 3A.

As illustrated in FIG. 3A, the target generator 26 may include a reservoir (target storage unit) 61, a nozzle (target output unit) 62, an electrode 63, a heater 64, an insulator 65, and a pull-out electrode 66. The reservoir 61 and the nozzle 62 may be formed integrally or separately.

The reservoir 61 may be formed of electrically non-conductive material, such as synthetic quartz ($SiO_2$), alumina ($Al_2O_3$), or any other suitable material. The reservoir 61 may store tin, serving as the target material, in a molten state thereinside. The heater 64 may be mounted around the reservoir 61 so as to heat the reservoir 61 such that tin stored inside the reservoir 61 may be retained in a molten state. In this way, the target material (tin) stored inside the reservoir 61 may be retained in a molten state. Further, the heater 64 may be used with a temperature sensor (not shown) for detecting the temperature of the reservoir 61, a heater power source (not shown) for supplying current to the heater 64, and a temperature controller (not shown) for controlling the heater power source based on the temperature detected by the temperature sensor.

The target material stored inside the reservoir 61 may be outputted as targets 27 toward the plasma generation region 25 through the nozzle 62. As illustrated in FIG. 3B, the nozzle 62 may be provided with a through-hole (orifice) through which the target material stored in the reservoir 61 is discharged. The nozzle 62 may have a tip portion projecting from a bottom surface for enhancing an electric field at the target material in the tip portion of the nozzle 62.

The insulator 65 may be attached to the nozzle 62 to hold the pull-out electrode 66. The insulator 65 may serve to provide electrical insulation between the nozzle 62 and the pull-out electrode 66. The pull-out electrode 66 may be arranged so as to face the bottom surface of the nozzle 62. Each of the insulator 65 and the pull-put electrode 66 may have a through-hole formed therein, through which the targets 27 may travel toward the plasma generation region 25.

With reference to FIG. 3A, the pressure adjuster 53 may be configured to adjust the pressure of the inert gas supplied from the inert gas cylinder 54 as necessary, and pressurize the target material inside the reservoir 61. The target control device 52 may be configured to control the pressure adjuster 53 and the pulse voltage generator 55 such that the targets 27 are generated at timings specified by the EUV light generation control device 51 (see FIG. 2).

Wiring connected to one of the output terminals of the pulse voltage generator 55 may be connected to the electrode 63, which is in contact with the target material inside the reservoir 61, through an airtight terminal (feedthrough) provided in the reservoir 61. Wiring connected to the other output terminal of the pulse voltage generator 55 may be connected to the pull-out electrode 66, for example, through a feedthrough provided in the chamber 2. The pulse voltage generator 55 may be configured to generate voltage signals V1 and V2 under the control of the target control device 52 to cause electrostatic force to act on the target material. The voltage signal V1 may be applied to the target material, and the voltage signal V2 may be applied to the pull-out electrode 66.

For example, the pulse voltage generator 55 may generate the voltage signal V1 that varies in pulses between the reference potential (0 V) and a potential P1, which is higher than the reference potential (0 V). Then, the generated voltage signal V1 may be applied to the target material through the electrode 63, and the voltage signal V2 that is retained at the reference potential may be applied to the pull-out electrode 66.

Alternatively, the pulse voltage generator 55 may generate the voltage signal V1 that varies between the potential P1, which is higher than the reference potential, and a potential P2, which is higher than the potential P1. Then, the generated voltage signal V1 may be applied to the target material through the electrode 63, and the voltage signal V2 that is retained at the potential P1 may be applied to the pull-out electrode 66.

With this, the potential of the target material may change in accordance with the voltage signal V1, and the potential of the pull-out electrode 66 may be retained constant in accordance with the voltage signal V2. In this way, a voltage (V2-V1) may be applied between the target material and the pull-out electrode 66. Alternatively, when the reservoir 61 or the nozzle 62 is formed of electrically conductive material, the pulse voltage generator 55 may apply the voltage (V2-V1) between the pull-out electrode 66 and either the reservoir 61 or the nozzle 62.

Here, in order to generate the targets 27 of a stable size and with stable charge amount at stable frequency, the voltage applied between the target material and the pull-out electrode 66 may need to be stable. However, when the buffer gas and/or the etching gas are present inside the chamber 2, a breakdown voltage between the target material and the pull-out electrode 66 may be decreased, and the breakdown may be more likely to occur. When the breakdown occurs between the target material and the pull-out electrode 66, the targets 27 of a stable size and with stable charge amount may not be generated at stable frequency, or worse, the targets 27 may not be generated.

Figures 4, 5:
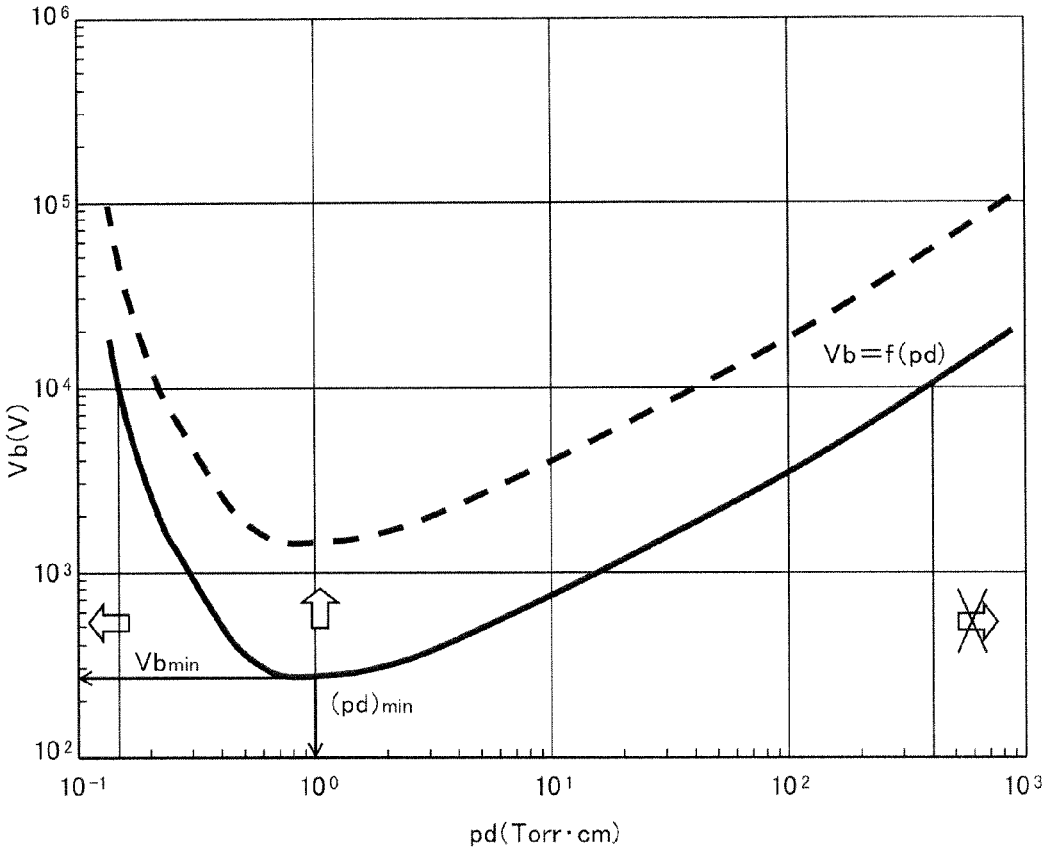
FIG. 4 is a diagram for discussing Paschen's Law.
FIG. 5 shows work functions of various materials.

FIG. 4 is a diagram for discussing Paschen's Law. As an example, a case where hydrogen gas is present between two electrodes between which a voltage is applied will be illustrated. In FIG. 4, the horizontal axis shows a product pd (Torr·cm) of pressure p (Torr) of hydrogen gas and a distance d (cm) between the electrodes; and the vertical axis shows a breakdown voltage Vb (V). Although the relationship between the product pd and the breakdown voltage Vb may vary depending on the shape and/or material of the electrodes or on the type of gas, the breakdown voltage Vb may fall to the minimum value $Vb_{min}$ when the product pd is around $10^{0}$ (Torr·cm).

A spark discharge may occur when an electron emitted and accelerated by an electric field collides with a gas molecule to ionize the gas. Accordingly, when the number of gas molecules is reduced, the collision may become less likely to occur. On the other hand, when the number of gas molecules is increased, the electrons may not be accelerated to a degree where collisions occur. Therefore, the product $pd_{min}$ where the breakdown voltage Vb is at the minimum value $Vb_{min}$ exists.

According to the Paschen's curve (solid line) shown in FIG. 4, when the voltage applied between the electrode 63 and the pull-out electrode shown in FIG. 3A is 10 kV, the breakdown (spark discharge) may be suppressed by satisfying the condition: pd<0.15 or pd>400. For example, when gas pressure p is 0.075 Torr (10 Pa), the range of the distance d that satisfies the above condition is d<2 cm or d>5333 cm. Here, when d>5333 cm, the potential gradient is small; thus, it may be difficult to pull out the targets 27. On the other hand, when d<2 cm, the potential gradient that is sufficient to pull out the targets 27 may be achieved while suppressing the breakdown.

Accordingly, the distance d between the nozzle 62 and the pull-out electrode 66 (see FIG. 3B) may preferably be set so as to form a potential gradient necessary to pull out the targets 27 while suppressing breakdown. In addition, the distance d may preferably be set to be greater than a diameter Dp of the target 27. Here, the Paschen's curve may vary depending on the conditions of the electrodes (i.e., the electrodes being flat or spherical, material of the anode) and/or the conditions of gas (e.g., the type of gas); thus, the distance d may be determined based on measurement in accordance with the shape and material of the nozzle 62 and the pull-out electrode 66 and/or the type and pressure of the gas.

The distance d does not need to be a distance of the portion shown in FIG. 3B, and may, for example, be the shortest distance between the periphery of the tip of the nozzle 62 and the periphery of the through-hole in the pull-out electrode 66. When there is a portion at which an electric field is enhanced due to the shape of the nozzle 62 and/or the pull-out electrode 66, the distance d may be set to a distance between portions where the breakdown voltage is found to be the lowest through an electric field simulation or the like.

When, for example, the pull-out electrode 66 is used as an anode, at least the surface of the pull-out electrode 66 may be formed of material that is less likely to emit electrons. With this, the Paschen's curve shown in FIG. 4 can be switched from the relationship shown in the solid line to the relationship shown in the broken line. Material with a high work function tends to be less likely to emit electrons, and thus may be suitable as material for the pull-out electrode 66. Here, the work function means the smallest energy required to extract a single electron from the surface of a given material to infinity.

FIG. 5 shows work functions (eV) of various materials. As shown in FIG. 5, selenium (Se), platinum (Pt), iridium (Ir), nickel (Ni), gold (Au), carbon (C), and cobalt (Co) are materials with relatively high work functions and may be suitable as the material for the pull-out electrode 66 and/or for the surface of the pull-out electrode 66. Accordingly, the pull-out electrode 66 itself may be made of a material with a high work function, or the surface of the pull-out electrode 66 may be coated with material with a high work function. For example, at least a portion of a surface of the pull-out electrode 66 facing the nozzle 62 may be coated with a material with a high work function.

Alternatively, or in addition, as shown in FIG. 3C, the surface of the pull-out electrode 66 may be coated with electrically non-conductive material 66*a*. The electrically non-conductive material 66*a* may be applied on a portion of the pull-out electrode 66 where a breakdown may occur between the pull-out electrode 66 and the tip of the nozzle 62, more specifically, a portion of the surface of the pull-out electrode 66 facing the nozzle 62. Coating the surface of the pull-out electrode 66 with the electrically non-conductive material 66*a* may make it less likely for the surface of the pull-out electrode 66 to emit electrons. As a result, compared to the case where the electrically non-conductive material 66*a* is not applied, the breakdown voltage Vb may be enhanced, and thus the breakdown may be suppressed. As the electrically non-conductive material 66*a*, ceramics that excels in electrical insulation, such as alumina, silicon dioxide ($SiO_2$), and silicon nitride ($Si_2N_3$), or glass may be used.

4.2 Operation

The target generator 26 may be configured to generate the targets 27 on-demand. The reservoir 61 may be heated by the heater 64 to a temperature at or above 232 degrees Celsius (melting point of tin). With this, tin, serving as the target material, may be stored inside the reservoir 61 in a molten state.

The target control device 52 (see FIG. 3A) may output target output signals to the pulse voltage generator 55. In accordance with the target output signals, the pulse voltage generator 55 may apply pulsed voltage between the target material and the pull-out electrode 66. With this, electrostatic force may be generated between the target material and the pull-out electrode 66, and with the electrostatic force, the target material may be pulled out from the tip of the nozzle 62 and divided into droplets. The generated droplets may be charged and serve as the targets 27. The target 27 may pass through the through-hole in the pull-out electrode 66 and be outputted from the target generator 26 toward the plasma generation region 25. When the target 27 reaches the plasma generation region 25, the target 27 may be irradiated by the laser beam. Upon being irradiated by the laser beam, the target 27 may be turned into plasma, and EUV light may be emitted from the plasma.

4.3 Effect

According to this embodiment, by suppressing emission of electrons from the pull-put electrode 66, the breakdown voltage of the pull-out electrode 66 may be enhanced, whereby the breakdown may be suppressed. As a result, the voltage applied between the target material and the pull-out electrode 66 may be stabilized, whereby the targets 27 may be supplied stably. Further, the chamber pressure controller 56 (see FIG. 2) may control the gas supply device 46 and the ventilation device 47 such that the gas pressure inside the chamber 2 is retained at a predetermined value based on the detection value of the pressure sensor 48. As a result, fluctuation in the breakdown voltage due to the fluctuation in the gas pressure may be suppressed, whereby the targets 27 may be outputted stably from the target generator 26.

Figure 6A:
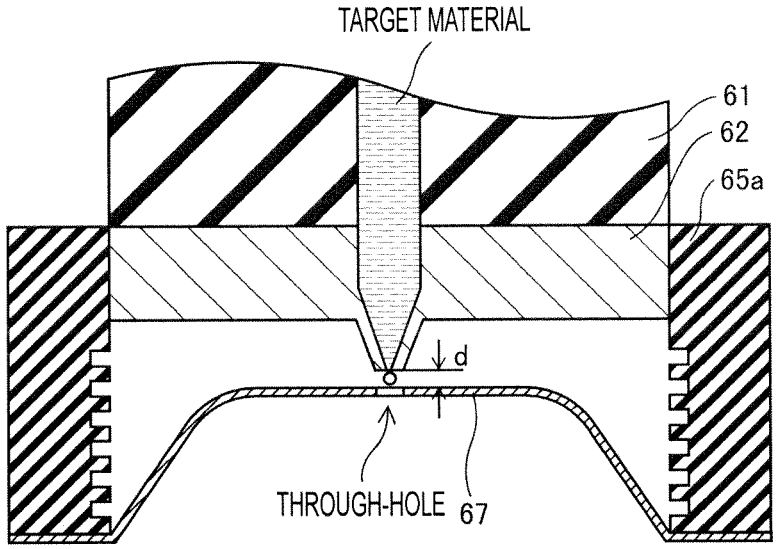
FIG. 6A is an enlarged sectional view illustrating a part of a target generator according to a second embodiment.
Figure 6B:
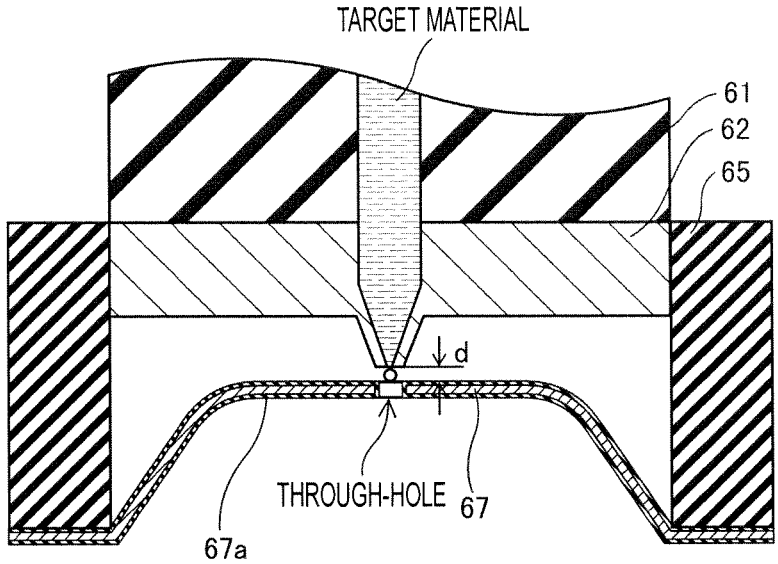
FIG. 6B is an enlarged sectional view illustrating a part of a modification of the target generator according to the second embodiment.

5. Breakdown Voltage Enhancement of Target Generator with Electrically Conductive Nozzle FIG. 6A is an enlarged sectional view illustrating a part of a target generator according to a second embodiment. FIG. 6B is an enlarged sectional view illustrating a part of a modification of the target generator according to the second embodiment. In the second embodiment, the nozzle 62 may have electrically conductive properties, and a pull-out electrode 67 may be shaped and positioned such that the center portion of the pull-out electrode 67 is closer to the nozzle 62 than the peripheral part of the pull-out electrode 67.

The nozzle 62 may be formed of a metal material, such as molybdenum (Mo), or any other suitable material. Further, a pull-out electrode 67 may be curved and positioned so that a portion around the through-hole is closer to the nozzle 62 than the peripheral part of the pull-out electrode 67. When the diameter of the target is Dp and the gas pressure p is 10 Pa, for example, the shortest distance d between the pull-out electrode 67 and the tip of the nozzle 62 may preferably satisfy the relationship Dp<d<2 cm. With this, as can be seen from the Paschen's curve (solid line) shown in FIG. 4, the breakdown voltage Vb may be equal to or greater than 10 kV. Further, since the center portion of the pull-out electrode 67 is positioned to be closer to the nozzle 62 than the peripheral part, the voltage applied between the pull-out electrode 67 and the nozzle 62 can be decreased while the field intensity between the pull-out electrode 67 and the nozzle 62 is retained.

Here, in order to prevent the electric field from being enhanced at a portion of the pull-out electrode 67, the peripheral part around the through-hole of the pull-out electrode 67 may preferably be curved. Further, an insulator 65*a* may preferably have a plurality of grooves formed in a surface facing a space between the nozzle 62 and the pull-out electrode 67. With this, a discharge path along the surface of the insulator 65*a* may be increased, and a creeping discharge may be suppressed when a high voltage is applied between the nozzle 62 and the pull-out electrode 67.

Further, the pull-out electrode 67 may be made of material having a high work function, or the surface of the pull-out electrode 67 may be coated with material having a high work function. With this, the breakdown voltage between the nozzle 62 and the pull-out electrode 67 may be enhanced.

Alternatively, or in addition, as shown in FIG. 6B, the surface of the pull-out electrode 67 may be coated with electrically non-conductive material 67*a*. Coating the surface of the pull-out electrode 67 with the electrically non-conductive material 67*a* may make it less likely for the surface of the pull-out electrode 67 to emit electrons. As a result, compared to the case where the electrically non-conductive material 67*a* is not applied, the breakdown voltage between the nozzle 62 and the pull-out electrode 67 may be enhanced. Further, as in the case shown in FIG. 6A, the insulator 65 may preferably have a plurality of grooves formed in a surface facing a space between the nozzle 62 and the pull-out electrode 67.

The electrically non-conductive material 67*a* may be applied on a portion where a breakdown may occur between the pull-out electrode 67 and the tip of the nozzle 62, more specifically, at least a portion of the surface of the pull-out electrode 67 facing the nozzle 62. As the electrically non-conductive material 67*a*, ceramics that excel in electrical insulation, such as alumina, silicon dioxide, and silicon nitride, or glass may be used.

Figure 7:
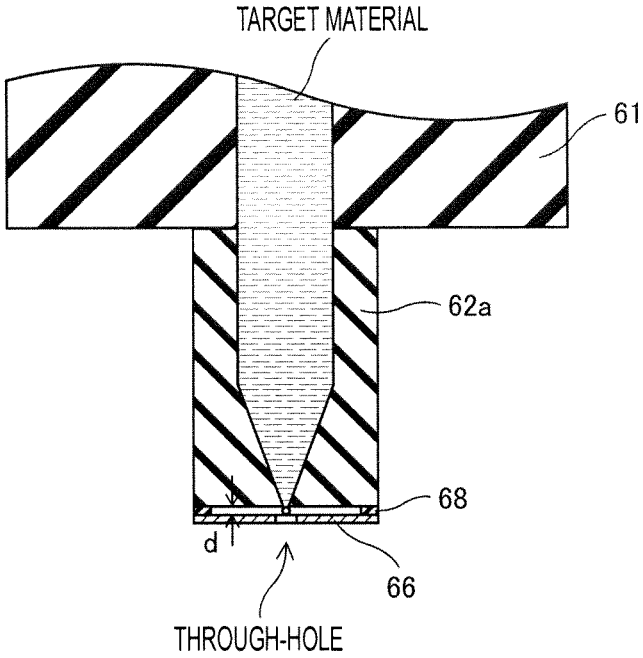
FIG. 7 is an enlarged sectional view illustrating a part of a target generator according to a third embodiment.

6. Breakdown Voltage Enhancement of Target Generator with Electrically Non-Conductive Nozzle FIG. 7 is an enlarged sectional view illustrating a part of a target generator according to a third embodiment. In the third embodiment, a nozzle 62*a* has electrically non-conductive properties, and the pull-out electrode 66 may be attached to the nozzle 62*a* with a spacer 68 provided therebetween. Note that the nozzle shown in FIGS. 8A, 8B, 12A, 12B, and 13 to be described later may also have electrically non-conductive properties.

The nozzle 62*a* may be made of an electrically non-conductive material, such as alumina or synthetic quartz. The spacer 68 may also be made of an electrically non-conductive material. The spacer 68 may have a predetermined thickness, and may be used to regulate the distance d between the pull-out electrode 66 and the tip of the nozzle 62*a* to a predetermined value. When the diameter of the target 27 is Dp and the gas pressure p is 10 Pa, for example, the distance d between the pull-out electrode 66 and the tip of the nozzle 62*a* may preferably satisfy Dp<d<2 cm. With this, as can be seen from the Paschen's curve (solid line) shown in FIG. 4, the breakdown voltage Vb between the surface of the target material and the pull-out electrode 66 may be equal to or greater than 10 kV.

Further, the pull-out electrode 66 may be made of material having a high work function, or the surface of the pull-out electrode 66 may be coated with a material having a high work function, whereby the breakdown voltage can be enhanced. Alternatively, or in addition, the surface of the pull-out electrode 66 may be coated with an electrically non-conductive material, whereby the breakdown voltage can be enhanced. As a result, a breakdown may be suppressed.

When the nozzle 62*a* is made of an electrically non-conductive material, a part of the bottom surface of the nozzle 62*a* may be included in a creeping distance between the target material and the pull-out electrode 66. With this, a creeping discharge may be suppressed.

7. Target Generator with Acceleration Electrode 7.1 Configuration

Figure 8A:
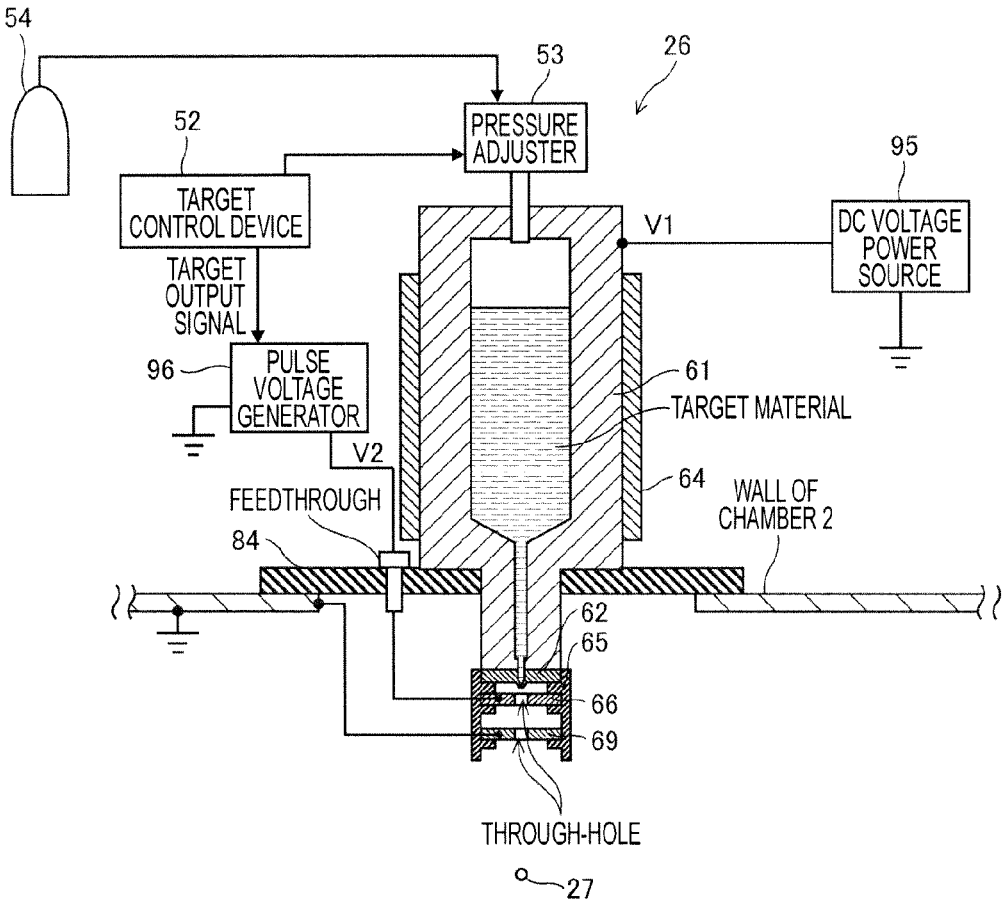
FIG. 8A is a sectional view illustrating a target generator and peripheral components thereof according to a fourth embodiment.
Figure 8B:
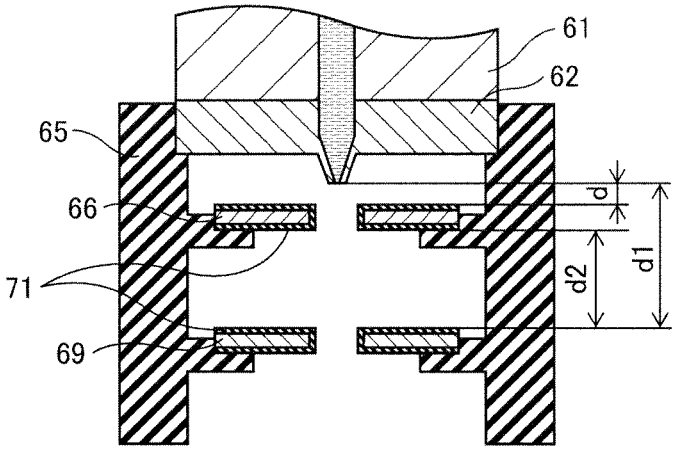
FIG. 8B is an enlarged sectional view illustrating a part of the target generator shown in FIG. 8A.

FIG. 8A is a sectional view illustrating a target generator and peripheral components thereof according to a fourth embodiment. FIG. 8B is an enlarged sectional view illustrating a part of the target generator shown in FIG. 8A. In the fourth embodiment, an acceleration electrode 69 may be added to the target generator shown in FIGS. 3A and 3B.

The target material may be retained at a constant potential, and the potential of the pull-out electrode 66 may be varied. Accordingly, a DC voltage power source 95 for applying a DC potential to the target material and a pulse voltage generator 96 for applying a voltage signal to the pull-out electrode 66 may further be provided.

The acceleration electrode 69 may be provided downstream from the pull-out electrode 66 in the direction in which the targets 27 travel. The acceleration electrode 69 may have a through-hole formed therein, through which the targets 27 travel. The acceleration electrode 69 may be provided in order to generate an electric field for accelerating the target 27 that has been outputted through the nozzle 62 and has passed through the pull-out electrode. The acceleration electrode 69 may be connected to the reference potential through an electrically conductive connecting member, such as a wire.

The reservoir 61 may be formed of an electrically conductive metal material, such as molybdenum (Mo), and may be mounted onto the chamber 2 through a flange 84 having electrically non-conductive properties. The DC voltage power source 95 may apply a DC potential to the target material through the reservoir 61.

FIG. 8B shows the pull-out electrode 66 and the acceleration electrode 69 held by the insulator 65 attached to the nozzle 62. Here, it is preferable that a breakdown is prevented from occurring between any two of the nozzle 62, the pull-out electrode 66, and the acceleration electrode 69.

For that, in accordance with the Paschen's Law, the type and pressure of gas, and distances d, d1, and d2 may be set so as to meet the condition for not causing the breakdown to occur. For example, when the application voltage is 10 kV, the gas pressure is 10 Pa, and the diameter of the target is Dp, the nozzle 62, the pull-out electrode 66, and the acceleration electrode 69 may be positioned so as to satisfy the conditions Dp<d<2 cm, Dp<d1<2 cm, and Dp<d2<2 cm. Here, the distances d, d1, and d2 may each be a distance between portions where the breakdown voltage is found to be the lowest from an electric field simulation or the like.

Further, the pull-out electrode 66 and/or the acceleration electrode 69 may be made of material with a high work function. Alternatively, the surface of the pull-out electrode 66 and/or the acceleration electrode 69 may be coated with a material with a high work function. For example, at least a part of the surface of the pull-out electrode 66 facing the acceleration electrode 69 and at least a part of the surface of the acceleration electrode 69 facing the pull-out electrode 66 may each be coated with material with a high work function. Preferably, a material with a high work function may be applied on the surface of the pull-out electrode 66 and the surface of the acceleration electrode 69 where the electric field may be enhanced. Portions where the electric field is enhanced may be identified through an electric field simulation or the like.

Alternatively, or in addition, as shown in FIG. 8B, the surface of the pull-out electrode 66 and/or the acceleration electrode 69 may be coated with electrically non-conductive material 71. For example, at least a part of the surface of the pull-out electrode 66 facing the acceleration electrode 69 and at least a part of the surface of the acceleration electrode 69 facing the pull-out electrode 66 may be coated with the electrically non-conductive material 71. Preferably, the electrically non-conductive material 71 may be applied on the surface of the pull-out electrode 66 and the surface of the acceleration electrode 69 where the electric field may be enhanced. As the electrically non-conductive material 71, ceramics that excels in electrical insulation, such as alumina, silicon dioxide, and silicon nitride, or glass may be used.

7.2 Operation

Figure 9:
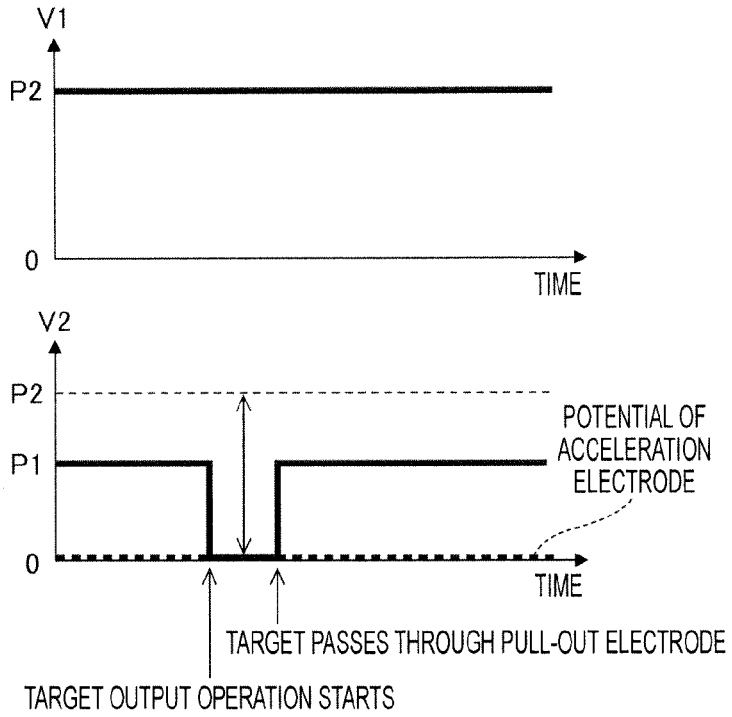
FIG. 9 is a timing chart showing a first example of the operation of the target generator shown in FIG. 8A.

FIG. 9 is a timing chart showing a first example of the operation of the target generator shown in FIG. 8A. The DC voltage power source 95 and the pulse voltage generator 96 may be configured to control a voltage signal V1 applied to the target material, a voltage signal V2 applied to the pull-put electrode 66, and a voltage signal applied to the acceleration electrode 69 as follows.

The DC voltage power source 95 may generate the voltage signal V1 which is retained at a potential P2 (e.g., 10 kV) that is higher than the reference potential. The pulse voltage generator 96 may generate the voltage signal V2 which varies between the reference potential and a potential P1 that is higher than the reference potential but lower than the potential P2. Here, a potential difference between the potential P2 and the potential P1 may preferably be lower than a threshold voltage for pulling out the target material, and a potential difference between the potential P2 and the reference potential may preferably be equal to or greater than the threshold voltage for pulling out the target material. With this configuration, a voltage (V1−V2) between the target material and the pull-out electrode 66 may vary between the potential difference (P2−P1) and the potential difference (P2−0), whereby the target material may be pulled out through the nozzle 62 when the voltage (V1−V2) is changed to the potential difference (P2−0) and a positively charged target 27 may be generated.

After the target 27 passes through the through-hole in the pull-out electrode 66, the pulse voltage generator 96 may raise the voltage signal V2 back to the potential P1. Here, the pulse voltage generator 96 may retain the voltage signal applied to the acceleration electrode 69 at the reference potential, which is equal to the potential of the chamber 2. With this, the target 27 may be accelerated.

Figure 10:
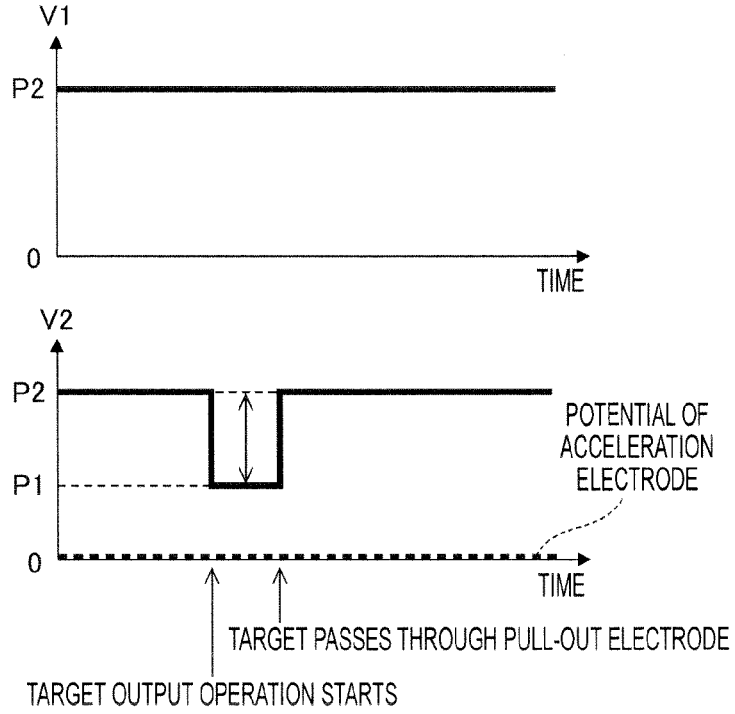
FIG. 10 is a timing chart showing a second example of the operation of the target generator shown in FIG. 8A.

FIG. 10 is a timing chart showing a second example of the operation of the target generator shown in FIG. 8A. The DC voltage power source 95 and the pulse voltage generator 96 may be configured to control a voltage signal V1 applied to the target material, a voltage signal V2 applied to the pull-put electrode 66, and a voltage signal applied to the acceleration electrode 69 as follows.

The DC voltage power source 95 may generate the voltage signal V1 which is retained at a potential P2 (e.g., 10 kV) that is higher than the reference potential. The pulse voltage generator 96 may generate the voltage signal V2 which varies between the potential 2 and a potential P1 that is higher than the reference potential but lower than the potential P2. Here, a potential difference between the potential P2 and the potential P1 may preferably be equal to or greater than the threshold voltage for pulling out the target material. With this configuration, a voltage (V1−V2) between the target material and the pull-out electrode 66 may vary between a potential difference (P2−P2) and the potential difference (P2−P1), whereby the target material may be pulled out through the nozzle 62 when the voltage (V1−V2) is changed to the potential difference (P2−P1) and a positively charged target 27 may be generated.

After the target 27 passes through the through-hole in the pull-out electrode 66, the pulse voltage generator 96 may raise the voltage signal V2 back to the potential P2. Here, the pulse voltage generator 96 may retain the voltage signal applied to the acceleration electrode 69 at the reference potential, which is equal to the potential of the chamber 2. With this, the target 27 may be accelerated.

8. Structure of Insulator

Figure 11A:
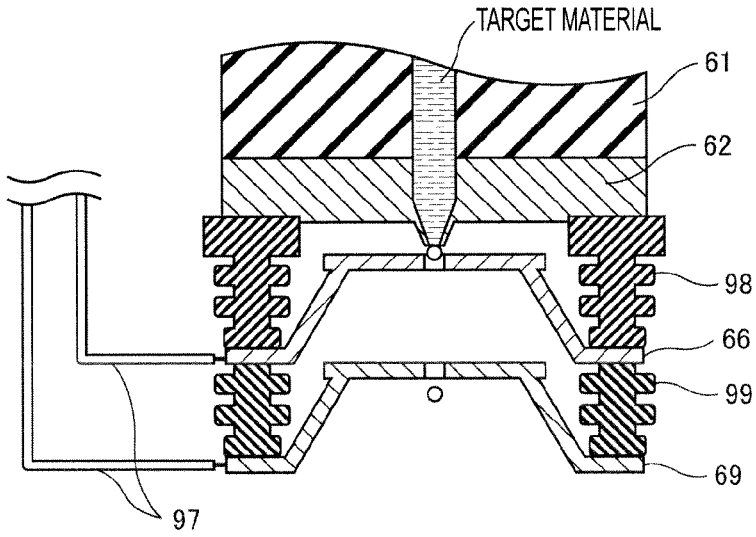
FIG. 11A is an enlarged sectional view illustrating a part of a target generator including corrugated insulators.
Figure 11B:
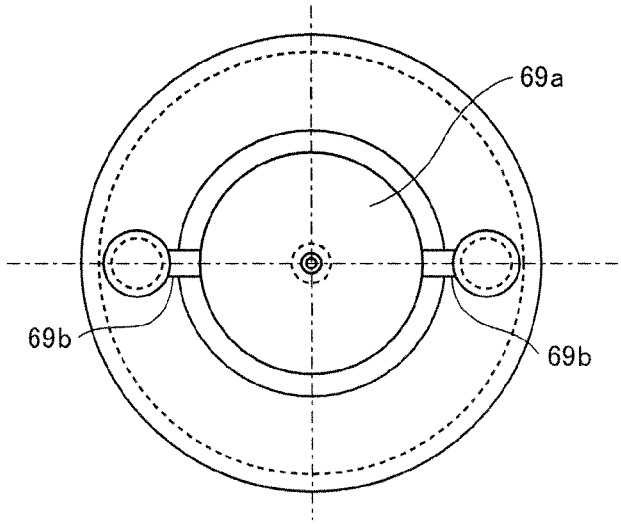
FIG. 11B is a bottom view showing a part of the target generator shown in FIG. 11A.
Figure 11C:
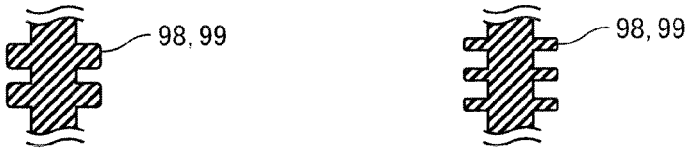
FIG. 11C is a sectional view showing variations of the corrugated insulator shown in FIG. 11A.

In one or more of the above-described embodiments, a corrugated insulator may be used. FIG. 11A is an enlarged sectional view illustrating a part of a target generator including corrugated insulators. FIG. 11B is a bottom view illustrating a part of the target generator shown in FIG. 11A. FIG. 11C is a sectional view illustrating variations of the corrugated insulator shown in FIG. 11A. As illustrated in FIG. 11A, the pull-out electrode 66 may be attached to the nozzle 62 through an insulator 98, and the acceleration electrode 69 may be attached to the pull-out electrode 66 through an insulator 99.

The insulators 98 and 99 may each be formed of an electrically non-conductive material, such as alumina ceramics, and may have a generally cylindrical shape with a plurality of corrugations formed on a side surface thereof. With this configuration, a breakdown voltage between the nozzle 62 and the pull-out electrode 66, and a breakdown voltage between the pull-out electrode 66 and the acceleration electrode 69 may be enhanced. The number of corrugations on the respective insulators 98 and 99 may be two or three, as shown in FIG. 11C, or any suitable number of corrugations may be formed. Wiring connected to the pull-out electrode 66 and to the acceleration electrode 69 may be Teflon® coated wires 97 in order to further enhance the breakdown voltages.

As illustrated in FIG. 11B, the acceleration electrode 69 may include an electrode body 69*a* having a through-hole formed therein, through which a target passes, and a plurality of supports (poles) 69*b* for supporting the electrode body 69*a*. The electrode body 69*a* and the supports 69*b* may be formed of a metal material, such as molybdenum, or any other suitable material. The structure of the pull-out electrode 66 may be similar to that of the acceleration electrode 69.

Figure 12A:
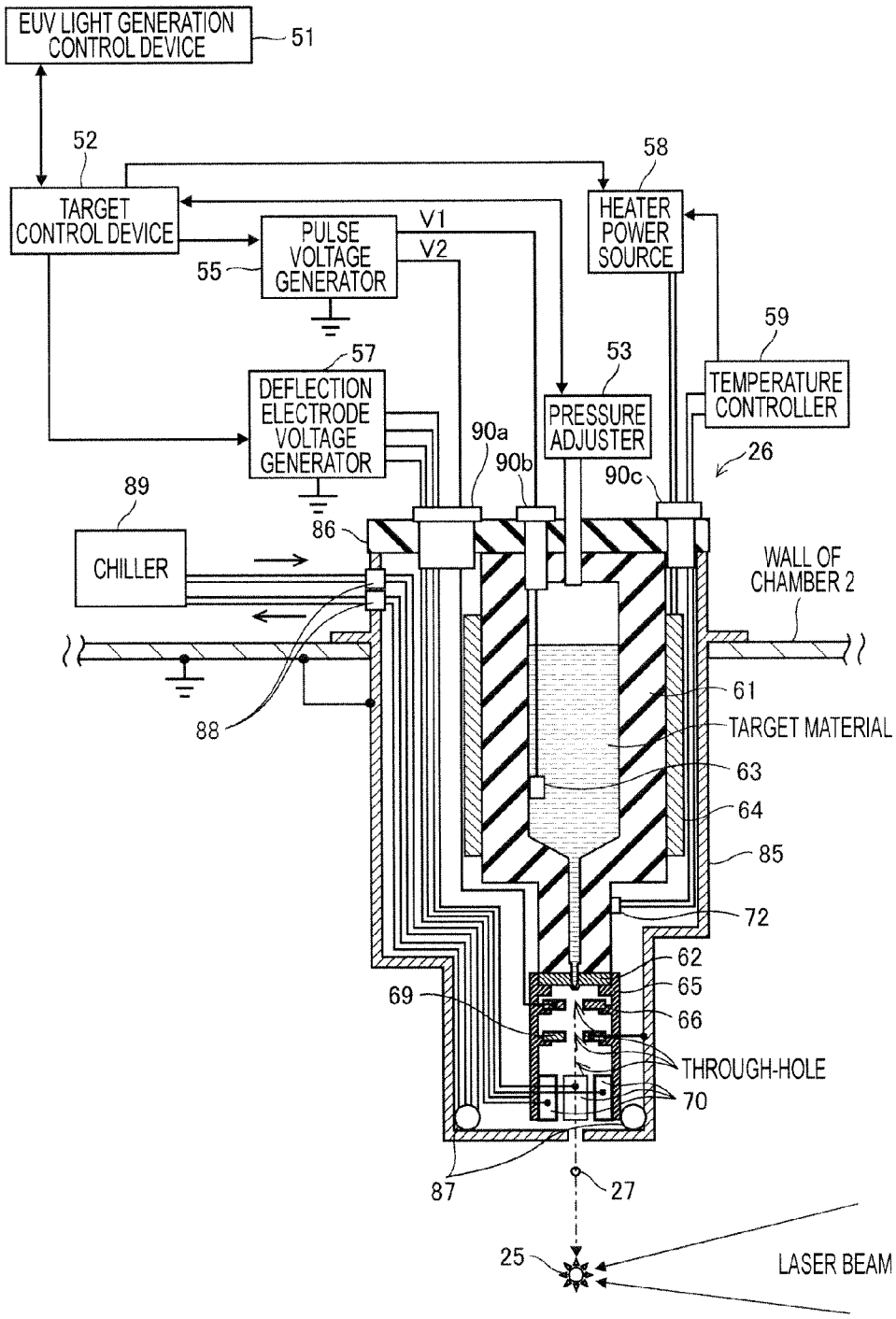
FIG. 12A is a sectional view illustrating a target generator and peripheral components thereof according to a fifth embodiment.
Figure 12B:
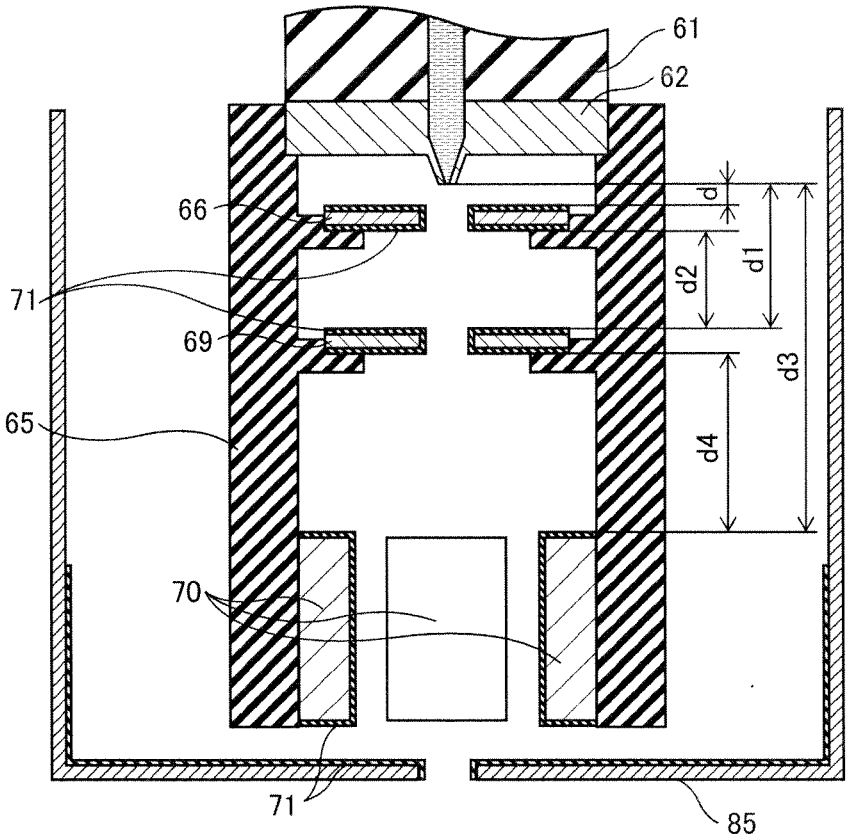
FIG. 12B is an enlarged sectional view illustrating a part of the target generator shown in FIG. 12A.

9. Target Generator with Acceleration Electrode and Deflection Electrodes 9.1 Configuration FIG. 12A is a sectional view illustrating a target generator and peripheral components thereof according to a fifth embodiment. FIG. 12B is an enlarged sectional view illustrating a part of the target generator shown in FIG. 12A. In the fifth embodiment, the acceleration electrode 69 and a plurality of deflection electrodes 70 may be added to the target generator shown in FIGS. 3A and 3B.

As illustrated in FIG. 12A, primary constituent elements of the target generator 26 may be housed in a shielding container including a shielding cover 85 and a lid 86 attached to the shielding cover 85. The shielding cover 85 may be arranged so as to shield at least the insulator 65 from the plasma generation region 25. The shielding cover 85 may have a through-hole formed therein, through which the targets 27 may travel toward the plasma generation region 25. The shielding cover 85 may be provided to shield electrically non-conductive members, such as the insulator 65, from charged particles emitted from plasma generated in the plasma generation region 25.

The shielding cover 85 may be formed of electrically conductive material, such as a metal, and connected electrically to the electrically conductive structural member (such as a wall) of the chamber 2 either directly or via an electrically conductive connecting member, such as wire. The electrically conductive structural member of the chamber 2 may be connected electrically to the reference potential of the pulse voltage generator 55, or may further be grounded. The lid 86 may be formed of an electrically non-conductive material, such as mullite.

In the target generator 26 according to the fifth embodiment, the acceleration electrode 69 may be provided downstream from the pull-out electrode 66 in the direction in which the targets 27 travel. Further, the plurality of deflection electrodes 70 may be provided downstream from the acceleration electrode 69 in the direction in which the targets 27 travel. The plurality of deflection electrodes 70 may be provided to generate an electric field for deflecting the travel direction of the target 27 that has passed through the through-hole in the acceleration electrode 69.

The pulse voltage generator 55 may retain a voltage signal V2 applied between to the pull-out electrode 66 at a potential P1 (10 kV, for example) that is higher than the reference potential. The pulse voltage generator 55 may generate a voltage signal V1 applied to the target material between the potential P1 and a potential P2 (20 kV, for example) that is higher than the potential P1. Here, a potential difference between the potential P2 and the potential P1 may preferably be equal to or greater than the threshold value for pulling out the target material. With this configuration, a voltage (V1−V2) between the target material and the pull-out electrode 66 may vary between a potential difference (P1−P1) and the potential difference (P2−P1), whereby the target material may be pulled out through the nozzle 62 when the voltage (V1−V2) is changed to the potential difference (P2−P1) and a positively charged target 27 may be generated.

After the target 27 passes through the through-hole in the pull-out electrode 66, the pulse voltage generator 55 may lower the voltage signal V1 back to the potential P1. Here, the pulse voltage generator 55 may retain the voltage signal applied to the acceleration electrode 69 at the reference potential, which is equal to the potential of the chamber 2. As a result, the target 27 may be accelerated. Here, the potentials P1 and P2 may preferably satisfy the following relationship.

$$0 \text{ (potential of chamber)} < P1 < P2$$

FIG. 12B shows the pull-out electrode 66, the acceleration electrode 69, and the plurality of deflection electrodes 70 held by the insulator 65 attached to the nozzle 62 inside the shielding cover 85. Here, it is preferable that a breakdown is prevented from occurring between any two of the nozzle 62, the pull-out electrode 66, the acceleration electrode 69, and the deflection electrodes 70.

For that, in accordance with the Paschen's Law, the type and pressure of gas, distances d, d1, d2, d3, and d4 may be set so as to meet the condition for not causing the breakdown to occur. For example, when the application voltage is 10 kV, the gas pressure is 10 Pa, and the diameter of the target is Dp, the nozzle 62, the pull-out electrode 66, the acceleration electrode 69, and the deflection electrodes 70 may be arranged so as to satisfy the conditions Dp<d<2 cm, Dp<d1<2 cm, Dp<d2<2 cm, Dp<d3<2 cm, and Dp<d4<2 cm. Here, the distances d, d1, d2, d3, and d4 may each be a distance between portions where the breakdown voltage is found to be the lowest from an electric field simulation or the like.

At least one of the pull-out electrode 66, the acceleration electrode 69, and the deflection electrodes 70 may be made of a material with a high work function. Alternatively, at least a surface of one of the pull-out electrode 66, the acceleration electrode 69, and the deflection electrodes 70 may be coated with a material having a high work function. For example, a material with a high work function may be applied on at least a part of the surface of the pull-out electrode 66 facing the acceleration electrode 69 and at least a part of the surface of the acceleration electrode 69 facing the pull-out electrode 66. Alternatively, the material with a high work function may be applied on at least a part of the surfaces of the deflection electrodes 70 facing each other. Preferably, the material with a high work function may be applied on the surface of at least one of the pull-out electrode 66, the acceleration electrode 69, and the deflection electrodes 70 where the electric field may be enhanced. Portions where the electric field is enhanced may be identified through an electric field simulation or the like.

Alternatively, or in addition, as shown in FIG. 12B, at least a surface of one of the pull-out electrode 66, the acceleration electrode 69, and the deflection electrodes 70 may be coated with the electrically non-conductive material 71. For example, the electrically non-conductive material 71 may be applied on at least a part of the surface of the pull-out electrode 66 facing the acceleration electrode 69 and at least a part of the surface of the acceleration electrode 69 facing the pull-out electrode 66. Alternatively, the electrically non-conductive material 71 may be applied on at least a part of the surfaces of the deflection electrodes 70 facing each other. Preferably, the electrically non-conductive material 71 may be applied on the surface of at least one of the pull-out electrode 66, the acceleration electrode 69, and the deflection electrodes 70 where the electric field may be enhanced. Alternatively, the electrically non-conductive material 71 may be applied on the inner surface of the shielding cover 85. As the electrically non-conductive material 71, ceramics that excels in electrical insulation, such as alumina, silicon dioxide, and silicon nitride, or glass may be used.

With reference to FIG. 12A, the reservoir 61 may be attached to the lid 86, which in turn is connected to the shielding cover 85. The reservoir 61 may be formed of an electrically conductive metal material such as molybdenum, semiconductor material such as silicon carbide (SiC), or electrically non-conductive material such as synthetic quartz or alumina. Similarly, the nozzle 62 may be formed of an electrically conductive metal material such as molybdenum, semiconductor material such as silicon carbide, or electrically non-conductive material such as synthetic quartz or alumina.

The heater 64 may be mounted around the reservoir 61 so as to heat the reservoir 61 such that tin stored inside the reservoir 61 may be retained in a molten state. In this way, the target material stored inside the reservoir 61 may be in a molten state. Further, the heater 64 may be used with a temperature sensor 72 for detecting the temperature of the reservoir 61, a heater power source 58 for supplying current to the heater 64, and a temperature controller 59 for controlling the heater power source 58 based on the temperature detected by the temperature sensor 72.

Wiring of the pull-out electrode 66 and wiring of the deflection electrodes 70 may be connected respectively to the pulse voltage generator 55 and to a deflection electrode voltage generator 57 via a relay terminal 90*a* provided in the lid 86. Wiring of the acceleration electrode 69 may be connected electrically to the shielding cover 85 or to the pulse voltage generator 55 via wiring (not shown) and a relay terminal 90*a*. Here, the deflection electrode voltage generator 57 may be a constituent element of the target generator 26 or a constituent element of the EUV light generation apparatus.

Wiring of the electrode 63 may be connected to the pulse voltage generator 55 via a relay terminal 90*b* provided in the lid 86. Wiring of the heater 64 and wiring of the temperature sensor 72 may be connected respectively to the heater power source 58 and the temperature controller 59 via a relay terminal 90*c* provided in the lid 86.

9.2 Operation

As current flows in the heater 64 from the heater power source 58, the reservoir 61 may be heated. The temperature control unit 59 may receive a detection signal from the temperature sensor 72, and control the current which flows in the heater 64 from the heater power source 58. The temperature of the reservoir 61 may be controlled to be equal to or higher than the melting point of tin serving as the target material.

The target control device 52 may be configured to output target output signals to the pulse voltage generator 55. With this, the target material may be pulled out through the nozzle 62, and the target 27 may be generated. The target 27 may then pass through the through-hole in the pull-out electrode 66. The target 27 that has passed through the through-hole in the pull-out electrode 66 may be accelerated as it travels through an electric field generated between the pull-out electrode 66 and the acceleration electrode 69, to which the reference potential is applied, and may pass through the through-hole in the acceleration electrode 69.

Two pairs of deflection electrodes 70 for deflecting the trajectory of the target 27 may be provided downstream from the acceleration electrode 69. When the target 27 needs to be deflected, the target control device 52 may output a control signal to the deflection electrode voltage generator 57 to thereby control a potential difference applied between each pair of deflection electrodes 70. The deflection electrode voltage generator 57 may be configured to apply a deflection electrode voltage between each pair of deflection electrodes 70. Deflection of the target 27 may be carried out based on a control signal from the EUV light generation control device 51. Here, various signals may be transmitted between the EUV light generation control device 51 and the target control device 52.

The target 27 that has passed through a space between each pair of deflection electrode 70, successively, may then pass through the through-hole in the shielding cover 85. Thereafter, when the target 27 reaches the plasma generation region 25, the target 27 may be irradiated by a laser beam. Upon being irradiated by the laser beam, the target 27 may be turned into plasma and EUV light may be emitted from the plasma.

Piping 87 may be provided on the shielding cover 85 to allow a heat carrier to circulate in the piping 87 to cool the shielding cover 85. The piping 87 may be connected to a chiller 89 via a joint 88, and the heat carrier may be cooled in the chiller 89 and circulate in the piping 87. With this configuration, the shielding cover 85 that may be exposed to radiation heat from plasma and charged particles such as ions and electrons may be prevented from being overheated.

9.3 Effect

According to this embodiment, emission of the electrons from at least one of the pull-out electrode 66, the acceleration electrode 69, and the deflection electrodes 70 may be suppressed, whereby the breakdown voltage between at least any two of the pull-out electrode 66, the acceleration electrode 69, and the deflection electrodes 70 may be enhanced and a breakdown may be suppressed. As a result, the targets 27 may be outputted from the target generator 26 stably.

Further, the electrically non-conductive members around the reservoir 61 and the nozzle 62 may be covered by the shielding container. Accordingly, the electrically non-conductive members may be prevented from being exposed to the charged particles such as ions and electrons by the shielding container. Further, the shielding cover 85 of the shielding container may be connected to the reference potential, whereby the shielding cover 85 may be prevented from being charged by the charged particles. With this, the fluctuation in the potential distribution (electric field) along the trajectory of the targets 27 may be suppressed, which may result in improvement in the positional stability of the charged targets 27.

10. Continuous-Jet Type Target Generator 10.1 Configuration

Figure 13:
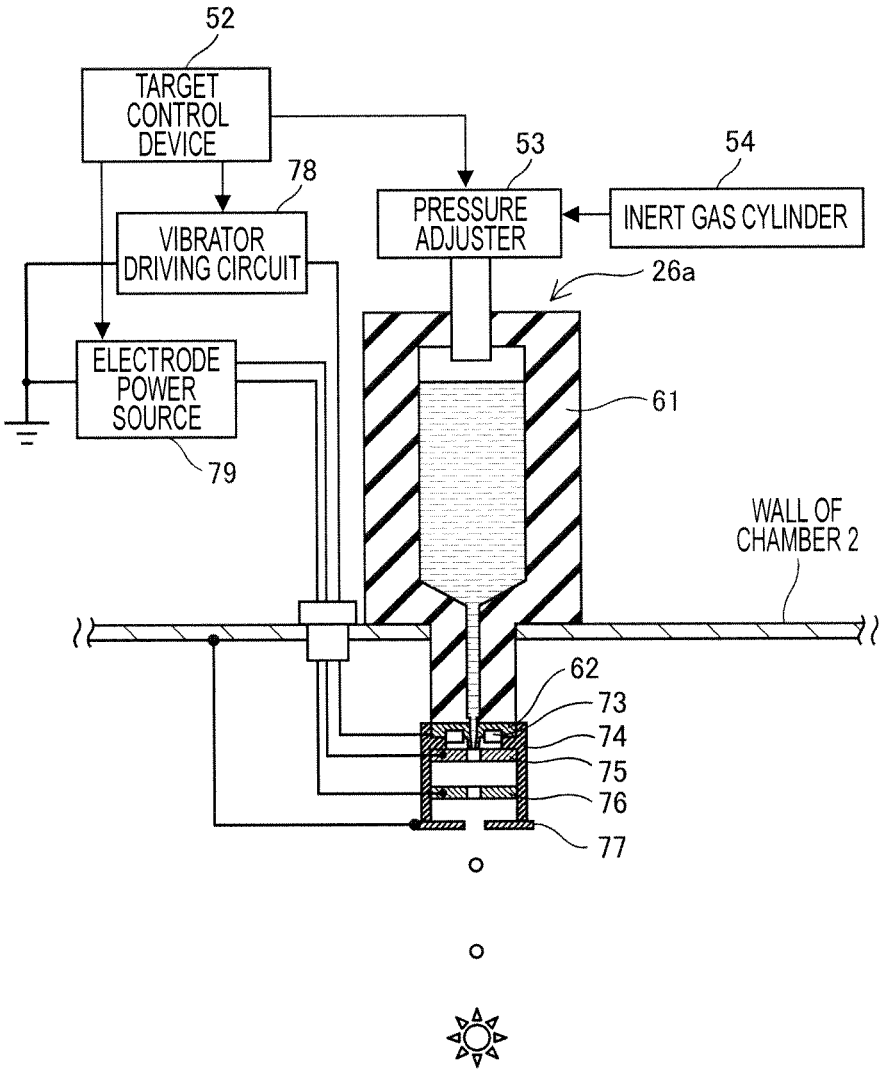
FIG. 13 is a sectional view illustrating a target generator and peripheral components thereof according to a sixth embodiment.

FIG. 13 is a sectional view illustrating a target generator and peripheral components thereof according to a sixth embodiment. A continuous-jet type target generator 26*a* may differ from the electrostatic-pull-out type target generator 26 (See FIG. 2) in the following points.

As illustrated in FIG. 13, a vibrator 73 including a piezoelectric element such as PZT (lead zirconate titanate) may be provided near the tip of the nozzle 62 of the target generator 26*a*. The vibrator 73 may add vibration to the nozzle 62 at a predetermined frequency in accordance with a driving signal. Further, a charging electrode 75 may be provided downstream from the nozzle 62 in the direction in which the targets 27 travel. The charging electrode 75 may serve to charge the target 27 when the jet of the target material is divided into droplets (targets).

The target generator 26*a* may include the reservoir 61, the nozzle 62, the vibrator 73, an insulator 74, the charging electrode 75, an acceleration electrode 76, and a shielding plate 77. The insulator 74 attached to the nozzle 62 may be configured to hold the charging electrode 75, the acceleration electrode 76, and the shielding plate 77. Each of the insulator 74, the charging electrode 75, the acceleration electrode 76, and the shielding plate 77 may have a through-hole formed therein, through which the target 27 may travel toward the plasma generation region 25.

A vibrator driving circuit 78 may be configured to supply the driving signal to the vibrator 73. An electrode power source 79 may be configured to apply a predetermined voltage each of the charging electrode 75 and the acceleration electrode 76. Here, the electrode power source 79 may be a constituent element of the target generator 26*a* or may be a constituent element of the EUV light generation apparatus. The shielding plate 77 may be formed of an electrically conductive material, and connected electrically to the electrically conductive structural member (such as the wall) of the chamber 2.

For example, the target material (or the nozzle 62) and the acceleration electrode 76 may be applied with the reference potential, and the charging electrode 75 may be applied either with a positive or negative potential. When the positive potential is applied to the charging electrode 75, the nozzle 62 and the acceleration electrode 76 may serve as anodes. On the other hand, when the negative potential is applied to the charging electrode 75, the charging electrode 75 may serve as an anode. Here, it is preferable that a breakdown is prevented from occurring between the nozzle 62 and the charging electrode 75 and between the charging electrode 75 and the acceleration electrode 76.

For that, in accordance with the Paschen's Law, the type and pressure of gas, distances d5 (not shown) between the nozzle 62 and the charging electrode 75, and a distance d6 (not shown) between the charging electrode 75 and the acceleration electrode 76 may be set so as to meet the condition for not causing the breakdown to occur. For example, when the application voltage is 10 kV, the gas pressure is 10 Pa, and the diameter of the target is Dp, the nozzle 62, the charging electrode 75, and the acceleration electrode 76 may be provided so as to satisfy the conditions Dp<d5<2 cm and Dp<d6<2 cm. Here, the distances d5 and d6 may each be a distance between portions where the breakdown voltage is found to be the lowest from an electric field simulation or the like.

The charging electrode 75 and the acceleration electrode 76 may be formed of a material with a high work function. Alternatively, the surface of each of the charging electrode 75 and the acceleration electrode 76 may be coated with the material with a high work function. For example, the material with a high work function may be applied on at least a part of the surface of the charging electrode 75 facing the nozzle 62 and at least a part of the surface of the charging electrode 75 facing the acceleration electrode 76. Preferably, the material with a high work function may be applied on a portion of the surface of the charging electrode 75 and the nozzle 62 where the electric field may be enhanced.

Alternatively, or in addition, the surface of each of the charging electrode 75 and the acceleration electrode 76 may be coated with electrically non-conductive material. For example, the electrically non-conductive material may be applied on at least a part of the surface of the charging electrode 75 facing the nozzle 62 and at least a part of the surface of the charging electrode 75 facing the acceleration electrode 76. Preferably, the electrically non-conductive material may be applied on a portion of the surface of the charging electrode 75 and the nozzle 62 where the electric field may be enhanced. As the electrically non-conductive material, ceramics that excels in electrical insulation, such as alumina, silicon dioxide, and silicon nitride, or glass may be used.

10.2 Operation

When the target control device 52 sends a pressurization signal to the pressure adjuster 53, the pressure adjuster 53 may supply an inert gas from the inert gas cylinder 54 in the reservoir 61 at predetermined pressure. As a result, a jet of the target material may be discharged through the nozzle 62. When the vibrator 73 adds vibration to the nozzle 62, the jet of the target material may be divided periodically into droplets. The charging electrode 75 may be provided at a position where the jet of the target material is divided into droplets (targets 27). The charging electrode 75 may serve to cause an electric field to act on the droplets, whereby the droplets may be charged.

Here, when the potential of the charging electrode 75 is retained at a lower potential than the potential of the target material, the target 27 is charged positively. On the other hand, when the potential of the charging electrode 75 is retained at a higher potential than the potential of the target material, the target 27 is charged negatively. Further, the electrode power source 79 may apply a predetermined voltage (for example, the reference potential) to the acceleration electrode 76, whereby the target 27 may be accelerated. The targets 27 may pass through the through-hole in the shielding plate 77 and reach the plasma generation region 25.

10.3 Effect

According to this embodiment, by selecting the material for the nozzle 62, the charging electrode 75, and the acceleration electrode 76 appropriately, emission of electrons from the nozzle 62, the charging electrode 75, and the acceleration electrode 76 may be suppressed, whereby the breakdown may be suppressed. As a result, the targets 27 may be outputted from the target generator 26*a* stably.

11. Controlling Direction of Target with Deflection Electrodes

Figure 14:
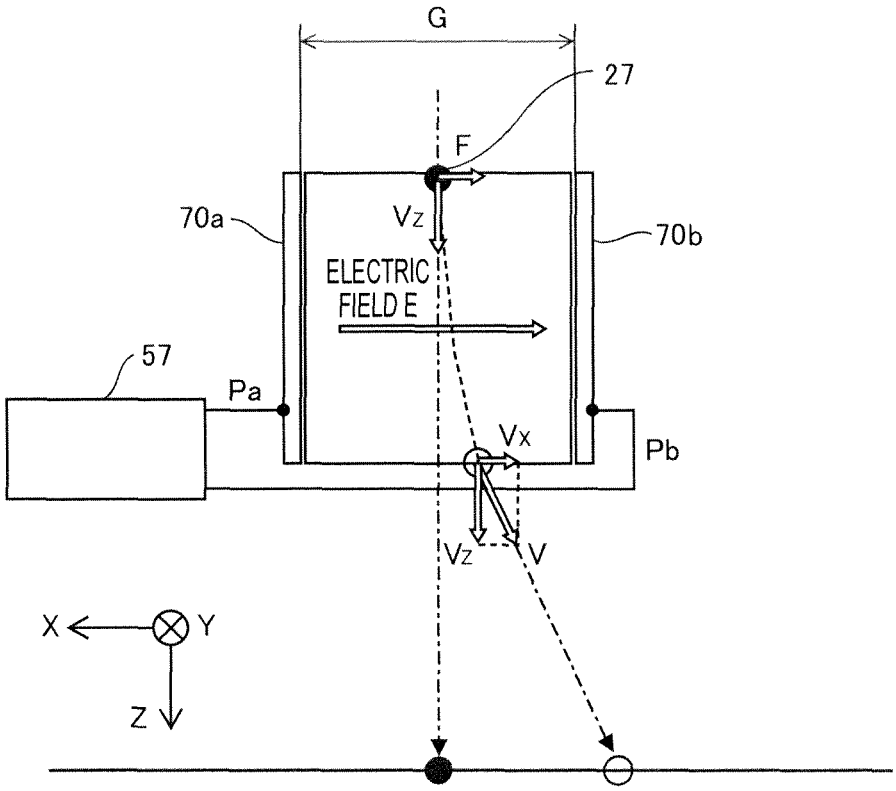
FIG. 14 is a diagram for discussing a method for controlling the travel direction of a target using deflection electrodes.

FIG. 14 is a diagram for discussing a method for controlling the travel direction of the target using the deflection electrodes. Here, the target 27 traveling in Z-direction may be deflected in X-direction using a pair of flat electrodes, serving as deflection electrodes, arranged to generate an electric field in X-direction.

The target 27 having a charge Q may be subjected to Coulomb force F expressed in the following expression in the direction of the electric field E.

$$F=QE$$

Here, the electric field E may be expressed in the following expression from a potential difference (Pa−Pb) between a potential Pa of a flat electrode 70*a* and a potential Pb of a flat electrode 70*b*, and a gap length G between the flat electrodes 70*a* and 70*b*.

$$E=(Pa-Pb)/G$$

When the target 27 enters the electric field with an initial speed $V_0$, the target 27 may be subjected to Coulomb force in the direction orthogonal to the direction in which the target 27 travels, whereby the direction in which the target 27 travels may be deflected. The target 27 may be accelerated in the X-direction by the Coulomb force while moving in the Z-direction with a Z-direction velocity component $V_z$ ($V_z=V_0$).

F=ma (m: mass of target, a: acceleration)

The target 27 may be subjected to the Coulomb force while the target 27 travels in the electric field.

Speed V of the target 27 when the target 27 exits the electric field may be expressed in the following expression based on the Z-direction velocity component $V_z$ and an X-direction velocity component $V_x$.

$$V=(V_z^2+V_x^2)^{1/2}$$

In this way, providing such a potential difference (Pa−Pb) that causes an electric field to act on a part of the trajectory of the target 27 may make it possible to deflect the direction in which the target 27 travels. Further, adjusting the potential difference (Pa−Pb) may make it possible to control the deflection amount. The target 27 that has exited the electric field may move at the speed V and arrive at the plasma generation region 25, where the target 27 may be irradiated by the laser beam. Here, with respect to the Y-direction, the direction of the target 27 may also be controlled by disposing a pair of flat electrodes in the Y-direction.

The above-described embodiments and the modifications thereof are merely examples for implementing this disclosure, and this disclosure is not limited thereto. Making various modifications according to the specifications or the like is within the scope of this disclosure, and other various embodiments are possible within the scope of this disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply unit, comprising:

a target storage unit for storing a target material therein-side;

a target output unit having a through-hole formed therein, through which the target material stored inside the target storage unit is outputted;

an electrode having a through-hole formed therein arranged to face the target output unit, the electrode being coated with an electrically non-conductive material at least on a part of a surface facing the target output unit;

a voltage generator for applying a voltage between the target material and the electrode; and an electrically non-conductive member attached to the target output unit for holding the electrode, the electrically non-conductive member being provided with a plurality of grooves in a surface facing a space between the target output unit and the electrode.

2. The target supply unit according to claim 1, wherein the target output unit has electrically conductive properties, and the electrode is curved and arranged such that a portion of the electrode around the through-hole is positioned toward an upstream side in a direction in which the target material travels than a peripheral portion of the electrode.

3. The target supply unit according to claim 1, further comprising an acceleration electrode having a through-hole formed therein, the acceleration electrode being grounded and being provided to accelerate the target material that has passed through the through-hole in the electrode, wherein electrically non-conductive material is applied on a part of a surface of the electrode facing the acceleration electrode and on a part of a surface of the acceleration electrode facing the electrode.

4. The target supply unit according to claim 1, further comprising:

at least a pair of deflection electrodes for deflecting the target material that has passed through the through-hole of the electrode; and a deflection voltage generator for applying a voltage between the pair of deflection electrodes, wherein electrically non-conductive material is applied on a part of respective surfaces of the deflection electrodes facing each other.

5. A target supply unit, comprising:

a target storage unit for storing a target material therein-side;

a target output unit having a through-hole formed therein, through which the target material stored inside the target storage unit is outputted;

an electrode having a through-hole formed therein arranged to face the target output unit, the electrode being formed of at least one of selenium (Se), platinum (Pt), iridium (Ir), nickel (Ni), gold (Au), carbon (C), and cobalt (Co), wherein the at least one of selenium (Se), platinum (Pt), iridium (Ir), nickel (Ni), gold (Au), carbon (C), and cobalt (Co) faces the target output unit;

a voltage generator for applying a voltage between the target material and the electrode; and an electrically non-conductive member attached to the target output unit for holding the electrode, the electrically non-conductive member being provided with a plurality of grooves in a surface facing a space between the target output unit and the electrode.

6. The target supply unit according to claim 5, wherein the target output unit has electrically conductive properties, and the electrode is curved and arranged such that a portion of the electrode around the through-hole is positioned toward an upstream side in a direction in which the target material travels than a peripheral portion of the electrode.

7. The target supply unit according to claim 5, further comprising an acceleration electrode having a through-hole formed therein, the acceleration electrode being grounded and being provided to accelerate the target material that has passed through the through-hole of the electrode, wherein the acceleration electrode is formed of at least one of selenium (Se), platinum (Pt), iridium (Ir), nickel (Ni), gold (Au), carbon (C), and cobalt (Co).

8. The target supply unit according to claim 5, further comprising:

at least a pair of deflection electrodes for deflecting the target material that has passed through the through-hole of the electrode; and a deflection voltage generator for applying a voltage between the pair of deflection electrodes, wherein each of the pair of deflection electrodes is formed of at least one of selenium (Se), platinum (Pt), iridium (Ir), nickel (Ni), gold (Au), carbon (C), and cobalt (Co).

9. An extreme ultraviolet light generation apparatus used with a laser apparatus, comprising:

a target storage unit for storing a target material therein-side;

a target output unit having a through-hole formed therein, through which the target material stored inside the target storage unit is outputted;

an electrode having a through-hole formed therein arranged to face the target output unit, the electrode being coated with an electrically non-conductive material at least on a part of a surface facing the target output unit;

a voltage generator for applying a voltage between the target material and the electrode;

a chamber having an inlet through which a laser beam from the laser apparatus is introduced into the chamber; and an electrically non-conductive member attached to the target output unit for holding the electrode, the electrically non-conductive member being provided with a plurality of grooves in a surface facing a space between the target output unit and the electrode.

10. The extreme ultraviolet light generation apparatus according to claim 9, wherein the voltage generator is configured to generate a voltage signal that varies between a first potential and a second potential that is higher than the first potential and to apply the first potential to the electrode and the voltage signal to the target material.

11. The extreme ultraviolet light generation apparatus according to claim 9, wherein the voltage generator is configured to generate a voltage signal that varies between a first potential and a second potential that is higher than the first potential and to apply the voltage signal to the electrode and a voltage higher than the second potential to the target material.

12. The extreme ultraviolet light generation apparatus according to claim 9, wherein the voltage generator is configured to apply a reference potential to the target material and a negative potential to the electrode.

13. An extreme ultraviolet light generation apparatus used with a laser apparatus, comprising:

a target storage unit for storing a target material therein-side;

a target output unit having a through-hole formed therein, through which the target material stored inside the target storage unit is outputted;

an electrode having a through-hole formed therein arranged to face the target output unit, the electrode being formed of at least one of selenium (Se), platinum (Pt), iridium (Ir), nickel (Ni), gold (Au), carbon (C), and cobalt (Co)), wherein the at least one of selenium (Se), platinum (Pt), iridium (Ir), nickel (Ni), gold (Au), carbon (C), and cobalt (Co) faces the target output unit;

a voltage generator for applying a voltage between the target material and the electrode;

a chamber having an inlet through which a laser beam from the laser apparatus is introduced into the chamber; and an electrically non-conductive member attached to the target output unit for holding the electrode, the electrically non-conductive member being provided with a plurality of grooves in a surface facing a space between the target output unit and the electrode.

14. The extreme ultraviolet light generation apparatus according to claim 13, wherein the voltage generator is configured to generate a voltage signal that varies between a first potential and a second potential that is higher than the first potential and to apply the first potential to the electrode and the voltage signal to the target material.

15. The extreme ultraviolet light generation apparatus according to claim 13, wherein the voltage generator is configured to generate a voltage signal that varies between a first potential and a second potential that is higher than the first potential and to apply the voltage signal to the electrode and a voltage higher than the second potential to the target material.

16. The extreme ultraviolet light generation apparatus according to claim 13, wherein the voltage generator is configured to apply a reference potential to the target material and a negative potential to the electrode.

* * * * *